United States Patent [19]

Flanders et al.

[11] Patent Number: 4,920,594

[45] Date of Patent: May 1, 1990

[54] APPARATUS FOR LASTING TOE, SIDE AND HEEL SEAT PORTIONS OF A SHOE

[75] Inventors: James R. Flanders, Blaby; Frank Bramley, Glenfield; Francis B. Sharp, Syston; Robert A. Newton, Cosby; Graham J. Mansfield, Newton Harcourt, all of England

[73] Assignee: British United Shoe Machinery Ltd., Leicester, England

[21] Appl. No.: 337,293

[22] Filed: Apr. 13, 1989

[30] Foreign Application Priority Data

Apr. 28, 1988 [GB] United Kingdom ..... 8810109

[51] Int. Cl.[5] ..... A43D 21/00; A43D 21/16; A43D 21/18

[52] U.S. Cl. ..... 12/7; 12/12; 12/12.5

[58] Field of Search ..... 12/12, 12.2, 12.3, 12.4, 12/12.5, 10, 10.5, 7, 1 R

[56] References Cited

U.S. PATENT DOCUMENTS

| | | | |
|---|---|---|---|
| 4,462,132 | 7/1984 | Flanders | 12/12 |
| 4,470,165 | 9/1984 | Becka | 12/12 |
| 4,553,281 | 11/1985 | Vornberger | 12/12 |
| 4,653,133 | 3/1987 | Giebel | 12/12.4 |
| 4,709,433 | 12/1987 | Walega | 12/12.5 |
| 4,777,685 | 10/1988 | Giebel et al. | 12/12 |

*Primary Examiner*—Steven N. Meyers

[57] ABSTRACT

The apparatus comprises a pulling over and toe lasting machine and a side and heel seat lasting machine. The pulling over and toe lasting machine comprises two linear potentiometers (102, 104) for monitoring the movement of the heel rest (26) both lengthwise and heightwise of a shoe, a left/right sensor (PrS2) and a proximity switch (PrS1) which senses when the wiper plates (20) reach a predetermined position in their inwiping movement and causes output value information from the potentiometers (102, 104) and left/right sensor (PrS2) to be "read". The side and heel seat lasting machine comprises two side lasting assemblies (36) tiltable in a direction lengthwise of the shoe, to accommodate to the spring of the last, and two adhesive-applying nozzles (40) arranged to track along opposite portions of the shoe. A further linear potentiometer (146) monitors the nozzle movement, and stepping motors (66) are provided for effecting tilting movement of the assemblies (36). The side and seat lasting machine also comprises computer control means (FIGS. 7 to 11) which received the output value information from the linear potentiometers (102, 104) and left/right sensor (PrS2) of the pulling and lasting machine and, in accordance therewith, causes the angle of tilt of the side lasting assemblies (36) and also the distance through which the nozzles (40) are driven to be set. The apparatus may also include an automatic unloading device (122).

40 Claims, 19 Drawing Sheets

APPARATUS FOR LASTING TOE, SIDE AND HEEL SEAT PORTIONS OF A SHOE

BACKGROUND OF THE INVENTION

This invention is concerned with apparatus for lasting toe, side and heel seat portions of a shoe.

Proposals have been made in the past for a combined apparatus for lasting toe, side and heel seat portions of a shoe (see e.g. U.S. patent specification No. 3359386), but in general it has been customary to provide three separate machines for effecting such operations, although in the more recent past the combination of side and heel seat lasting in a single machine has become widespread (see e.g U.S. patent specification No. 4395790), while proposals have been made for combining toe and side lasting operations (see e.g. U.S. patent specification No. 4407033).

In many instances, however, it is preferable to utilize individual machines, thereby giving greater flexibility in the manufacture of shoes; for example, where the various operations are carried out using more than one machine, the breakdown of one of those machines will not entirely prevent the continued production of shoes, whereas in a single machine combining all the functions into one, the breakdown of any component part of the machine is likely to hold up production entirely.

At the same time, however, there is an increasingly recognized need to reduce the amount of labor involved in the manufacture of shoes and to this end operators are being required more and more to operate more than one machine, where a combination of machines is seen to be appropriate in terms of operating cycle times and the operator time required for loading and unloading each individual machine. One of the main problems in this regard, however, is that of setting up each machine according to the particular shoe to be operated upon, since where the operator has to make adjustments to two machines a significant loss of production is thereby created.

OBJECT OF THE INVENTION

It is thus the object of the present invention to provide an apparatus for lasting toe, side and heel seat portions of shoes, which apparatus comprises a so-called pulling over and toe lasting machine and a side and heel seat lasting machine, which machines together are sufficient to last the whole of a shoe, in which apparatus the setting up of the machines can be effected at one only of such machines, the other being automatically set from the first.

BRIEF SUMMARY OF THE INVENTION

The invention thus provides apparatus for lasting toe, side and heel seat portions of a shoe, comprising a pulling over and toe lasting machine and a side and heel seat lasting machine, wherein the pulling over and toe lasting machine comprises first transducer means for monitoring the movement of a heel end engaging support member of the machine relative to a toe support thereof, second transducer means for monitoring adjustment movement of said heel end engaging member heightwise of the machine, and actuator means whereby, when wiper plates of a wiper assembly of said machine reach a predetermined position in their inwiping movement, the output value of each of the first and second transducer means is "read", and wherein the side and heel seat lasting machine comprises two side lasting assemblies each of which can tilt in a direction lengthwise of a shoe supported by a shoe support of said machine, to accommodate to the spring of the last of the shoe to be operated upon, adhesive-applying means comprising two nozzles arranged to track along opposite side portions of the shoe thus supported, first motor means for driving the nozzles as aforesaid, second motor means for effecting tilting movement of the side lasting assemblies, and computer control means which receives the output value information from the first and second transducer means and in accordance therewith, in a cycle of operation of the machine, causes the second motor means to be actuated to set the angle of tilt of the side lasting assemblies and causes the distance to be set through which the nozzles are driven by the first motor means.

It will thus be appreciated that, using this apparatus in accordance with the invention, the side and heel seat lasting machine can be set for each individual shoe according to the setting, lengthwise and heightwise of the shoe bottom, of the heel end engaging support member (usually called the heel rest) of the pulling over and toe lasting machine. It will of course also be appreciated that the operator is not required to carry out any function other than he would normally carry out using a pulling over and toe lasting machine in a conventional operation, since necessarily he will set the height of the heel rest according to the spring of the shoe last, and thus the height of the heel end thereof, and also cause the heel rest to be moved toewardly to a point at which it engages the shoe heel end. Moreover, the pulling over and toe lasting machine is effectively a "standard" machine, except for the addition of the first and second transducer means and the actuator means thereof. Thus, no significant structural modifications need to be made to the machine in order for it to be able to be used in a combination as above described.

In certain side and heel seat lasting machine (see e.g. UK Patent Specification No. 2118867) the adhesive supplied by the nozzles is applied to upstanding lasting marginal portions of the shoe upper, rather than to e.g. the insole. In order therefore to take account of the fact that the lasting marginal portions in the heel seat region of the shoe will have been flanged in a previous backpart molding and seat flanging operation, and thus will lie relatively closely to the insole, whereas in the waist region of the shoe the lasting marginal portions will be upstanding, but further towards the previously lasted forepart portion again the lasting marginal portions will lie more closely to the insole, provision is made for maintaining the nozzles spaced from the shoe bottom by a distance which can be varied, according to the aforementioned considerations, as the nozzles track along opposite sides of the shoe. Where such a machine is used in the apparatus in accordance with the present invention, furthermore, preferably the computer control means is effective, in accordance with the output value information received from the first and second transducer means, to cause such variation to take place at predetermined points along the path of the nozzles. Moreover, in addition to determining the distance through which the nozzles move as aforesaid, the computer control means is conveniently also effective, also in accordance with the output value information received from the first and second transducer means, to switch off the flow of adhesive to the nozzles. Such switching off will usually take place prior to the end of traverse of the nozzles, so that the nozzles can be effectively wiped clean, thereby reducing the risk of drooling when the machine is in its rest condition.

Conventionally in pulling over and toe lasting machines the user is provided with a choice as to the amount of the shoe upper to be lasted by said machine. In one case, the lasting terminates just short of the ball region, i.e. the region of the shoe bottom where, in the case at least of a high-heeled shoe, the shoe bottom has a significant contour in the waist region, and in this case a flat, generally U-shaped, so-called imprinter plate is provided for applying adhesive to lasting marginal portions of the insole, prior to the operation of wiper means of the pulling over and toe lasting machine, by which wiper means lasting marginal portions in the toe and forepart regions of the shoe are wiped inwards and pressed against corresponding marginal portions of the insole, to which adhesive has been thus applied, to bond them together. In the other case, however, the lasting will take place over such ball region of the shoe bottom, and to this end conventionally additional nozzle plates are provided which can accommodate to the curvature of the shoe bottom beyond the ball region. In at least one instance (see e.g. U.S. patent specification No. 4601257) the nozzle plates are secured, one at either end of the "legs" of the U-shaped imprinter plate, for pivotal movement about three axes. In such a case, however, there is a tendency for such additional nozzle plates merely to form a tangent to the curvature of the shoe bottom so that the distance to which adhesive is applied thereby will not necessarily extend over the full lengthwise dimension of the thus extended imprinter plate; rather the area over which adhesive is thus applied has been found to be a proportion of the overall shoe length.

To accommodate these features of conventional pulling over and toe lasting machines, the apparatus in accordance with the invention preferably also comprises manually operable input means for inputting to the computer control means information relating to the lengthwise dimension of adhesive-applying means of the pulling over and toe lasting machine, such information together with the output value information received from the first and second transducer means serving to determine the distance through which the nozzles are caused to track as aforesaid. More particularly, conveniently the manually operable input means enables the input selectively of either a specific lengthwise dimension or of an instruction to calculate the appropriate lengthwise dimension using a program relating such dimension proportionately to the length of the shoe as determined according to the output information received from the first and second transducer means. Such program will of course have been previously determined empirically according to the particular type of additional nozzle plates by which the imprinter plate is extended.

In a number of conventional side and heel seat lasting machines (see e.g. U.S. patent specifications Nos. 4601257 and 4395790) each side lasting assembly is made up of a plurality of lasting members arranged side-by-side along the length of the side portion of a shoe to be operated upon. Where such a machine is utilized in an apparatus in accordance with the present invention, furthermore, preferably, in accordance with the output value information received from the first and second transducer means, only as many such members are actuated as correspond to the distance through which the nozzles are caused to track as aforesaid. In this way, the risk of other portions of the shoe bottom previously lasted being damaged or otherwise adversely affected can be avoided.

It will be appreciated that in both toe lasting machines and heel seat lasting machines customarily wiper assemblies are provided, usually comprising two wiper plates which are arranged symmetrically about a longitudinal center line of the operating locality of the machine. It will thus further be appreciated that whereas each end of a shoe tends to be symmetrical over at least a short distance, the center line about which such symmetry arises is in each case offset from the heel-to-toe center line of the shoe. Consequently, customarily the shoe has to be set in the machine according to whether it is a left or a right; in pulling over and toe lasting machines, therefore, the heel rest can be pivoted between two positions to accommodate left and right shoes, and similarly in a side and heel seat lasting machine the toe rest is so movable.

Where the pulling over and toe lasting machine and the side and heel seat lasting machine forming part of the apparatus in accordance with the present invention are each so equipped, conveniently also the pulling over and toe lasting machine is provided with sensing means for sensing in which position the heel rest is located and the actuator means is effective to cause the status of said sensing means to be read when the output value for each of the first and second transducer means is read as aforesaid, and furthermore in accordance with the status, as read, of the sensing means the shoe support of the side and heel seat lasting machine is positioned, for a left or a right shoe, under the control of the computer control means.

In order to benefit, in terms of productivity, from a combination of machines as set out above, it will be appreciated that, while shoes are operated upon in sequence firstly in the pulling over and toe lasting machine and thereafter in the side and heel seat lasting machine, the operator may in fact be loading a next shoe in the pulling over and toe lasting machine before he loads the previously toe-lasted shoe into the side and heel seat lasting machine. For ensuring, therefore, that the correct style and size information is imparted to the side and heel seat lasting machine for each individual shoe, it is necessary to cater for the particular operating system which the operator pursues. To this end, therefore, conveniently in accordance with the present invention the computer control means comprises a memory in the form of a table having a plurality of addresses in which output value information received in response to operation of the actuator means in respect of successive shoes is stored in sequence, together with means for accessing each such address in sequence and setting up the side and heel seat lasting machine accordingly.

It will further be appreciated that in some circumstances the operator may not be satisfied with the quality of the lasting which has been achieved in any given cycle of operation of the pulling over and toe lasting machine and consequently will wish to take that shoe out of the operating sequence. The output value information, however, relating to that shoe will already have been passed for storage in the memory of the computer control means and consequently it will be necessary, in order to achieve a smooth flow of output of the two machines, to override or otherwise cancel such output value information. To this end, therefore, conveniently in accordance with the present invention operator-actuatable canceling means is provided whereby, in the event that a shoe operated upon in the pulling over and toe lasting machine is not passed to the side and heel seat lasting machine in sequence, but the output value information received from the first and second transducer means for that shoe has been stored by the computer control means for use in carrying out the next operating cycle of the side and heel seat lasting machine, the operator can cancel the stored information. More particularly, where the information is stored at an address in the memory table, in the event that a shoe in respect of which output value information has been stored in one of the addresses of the memory table as aforesaid is not passed to the side and heel seat lasting machine, the address next in sequence to said one address is next accessed for setting up the side and heel seat lasting machine.

Similarly, it will be appreciated, the operator may not be satisfied with the quality of a lasting operation carried out in the side and heel seat lasting machine and will wish to carry out this lasting operation again. In such circumstances, in accordance with the present invention conveniently operator-actuatable "repeat" means is provided whereby, after an operating cycle of the side and heel seat lasting machine has been effected in accordance with the output value information stored in one of the addresses of the memory table, the same address can again be accessed for the next operating cycle of the machine. It will of course be appreciated that such an operating cycle may be repeated without affecting the sequence in which output value information is stored by the computer control means, and consequently the sequence in which the machine is set up for each successive shoe.

In order to enhance the flexibility of the apparatus in accordance with the invention, bearing in mind that the pulling over and toe lasting machine may be used independently of the side and heel seat lasting machine using the operator-actuatable canceling means if the information is not required for storage for a subsequent side and heel seat lasting operation, preferably also the side and heel seat lasting machine has selector means whereby an "automatic" operating mode can be selected, in which the machine is set up in accordance with the output value information received from the first and second transducer means, or a "manual" operating mode can be selected, in which the machine is set up using operator-settable machine control means; moreover, in the event that a manual operating mode is selected, the last-received output value information received from the first and second transducer means is stored until an automatic operating mode is thereafter selected. In this way, the side and heel seat lasting machine may be utilized for "one off" jobs without interrupting the flow of output value information. Furthermore, the side and heel seat lasting machine can thus be utilized as a stand-alone machine.

Furthermore, where operator-settable machine control means is provided as aforesaid, conveniently it can also be used, when the automatic operating mode has been selected, to vary the machine settings as determined by the computer control means in accordance with the output value information received from the first and second transducer means, the computer control means storing the variation information and thereafter applying it in determining the machine settings as aforesaid. It will of course be appreciated that in other apparatus in accordance with the invention without such a manual selection facility, operator-settable machine control means may nevertheless be provided for varying the settings determined by the computer control means as aforesaid.

Conveniently, furthermore, just as the "automatic mode" information remains stored when a manual operating mode has been selected, the machine setting information which, when a manual operating mode has been selected, is set using the operator-settable machine control means is stored by the computer control means not only while such manual operating mode remains selected, but also in the event that an automatic operating mode is selected, and is recallable in the latter case when a manual operating mode is thereafter once more selected.

It will be appreciated that in this way a highly flexible combination of pulling over and toe lasting machine and side and heel seat lasting machine is thus afforded by the present invention.

Turning to more details of the machines themselves, preferably in the side and heel seat lasting machine the second motor means comprises two n.c. motors (as hereinafter defined), one associated with each of the side lasting assemblies. By the term "n.c. motor" where used herein is to be understood a motor the operation of which is controlled by control or drive signals supplied thereto in accordance with stored information appropriate to a desired operation, such information usually being stored in the form of digitized coordinate axis values. Examples of such motor are stepping motors and d.c. servomotors.

Moreover, it is convenient for such motors to be driven by an "open loop" circuit, but in such circumstances desirably facilities should be provided for calibrating each motor. To this end in an apparatus in accordance with the present invention each assembly can preferably be moved by its motor to a datum position, at which the motor is then zeroed. Moreover, in such apparatus, desirably indicator means is provided, operable in response to either of the side lasting assemblies being prevented from being set in accordance with the output value information, for indicating that calibration of the motors is required. In addition, the indicator means may be actuated also if the side lasting assemblies are signaled to be driven beyond pre-set limits.

For controlling the distance through which the nozzles are moved in accordance with the output value information received from the first and second transducer means, furthermore, further transducer means is preferably associated with the first motor means, said further transducer means conveniently also being further used for controlling the flow of adhesive from the nozzles and also heightwise movement of the nozzles relative to the shoe bottom and to incidence of such movement. To this end, furthermore, the output value of the further transducer means is conveniently compared with other values set appropriately by the computer means in accordance with the output value means information received from the first and second transducer means, the or each function being caused to take place when the output value of the further transducer means matches the or each corresponding set value; in this way, it will be appreciated, a relatively simple system is provided for effecting the various functions of the nozzles as they track along the shoe bottom.

Further to enhance the flexibility of the apparatus in accordance with the invention and also to reduce the amount of activity necessarily carried out by the operator, thereby enhancing the productivity of the apparatus in accordance with the invention, said apparatus preferably also comprises an automatic unloading device whereby a finished shoe can be removed from the shoe support of the side and heel seat lasting machine; one such device is described in U.S. patent specification No. 4599759. Furthermore, if desired, as described in this last-mentioned specification, the automatic unloading device may directly transfer the shoe to a heat setting apparatus.

In order to ensure that the various functions of the side and heel seat lasting machine and the automatic unloading device take place in a controlled time relationship, furthermore, inhibiting means is preferably provided for delaying the setting of the side and heel seat lasting machine for the next operating cycle thereof to allow for the removal of the finished shoe by the automatic unloading device. In particular, said inhibiting means serves to delay the left/right setting of the shoe support of the side and heel seat lasting machine for the next operating cycle until after the shoe has been removed. In this way, no movement of the shoe is likely to be taking place during the operation of the automatic unloading device.

In certain cases it may be desirable to render the automatic unloading device non-automatic, and to this end conveniently the apparatus in accordance with the present invention also comprises switch means for selecting a manually initiated mode of operation of the device. In such circumstances, furthermore, preferably selection of such mode is effective to disable the inhibiting means, since when manually initiated, the operator will himself ensure that no movement of the shoe is taking place during the unloading. In addition, the side and heel seat lasting machine may comprise mode selector means whereby, when a manual operating mode has been selected as aforesaid, either an "automatic left/-right" mode, in which at the end of each operating cycle the shoe support of said machine is automatically switched to accommodate the opposite hand of shoe in the next operating cycle, or a "manual left/right" mode is selected, in which the setting of the shoe support is determined by the operator for each operating cycle. More particularly in the case where the mode selector means is provided, conveniently in response to selection of the automatic left/right mode by the mode selector means a first signaling device is actuated the status of which is "read" by the computer control means, and when the unloading device is caused to operate a second signaling device is actuated, the arrangement being such that status of the second signaling device is "read" by the computer control means only if the status of the first signaling device indicates that the automatic left/-right mode has been selected. Furthermore, when the status of the second signaling device is read as indicating that operation of the unloading device has been initiated a timer device is actuated, timing out of said device being effective to initiate the setting of the side and heel seat lasting machine for the next operating cycle.

BRIEF DESCRIPTION OF THE DRAWINGS

There now follows a detailed description, to be read with reference to the accompanying drawings, of one apparatus in accordance with the invention for lasting toe, side and heel seat portions of shoes. It will of course be appreciated that this apparatus has been selected for description merely by way of non-limiting example.

In the accompanying drawings.

DESCRIPTION OF THE PREFERRED EMBODIMENT

Figure 1:
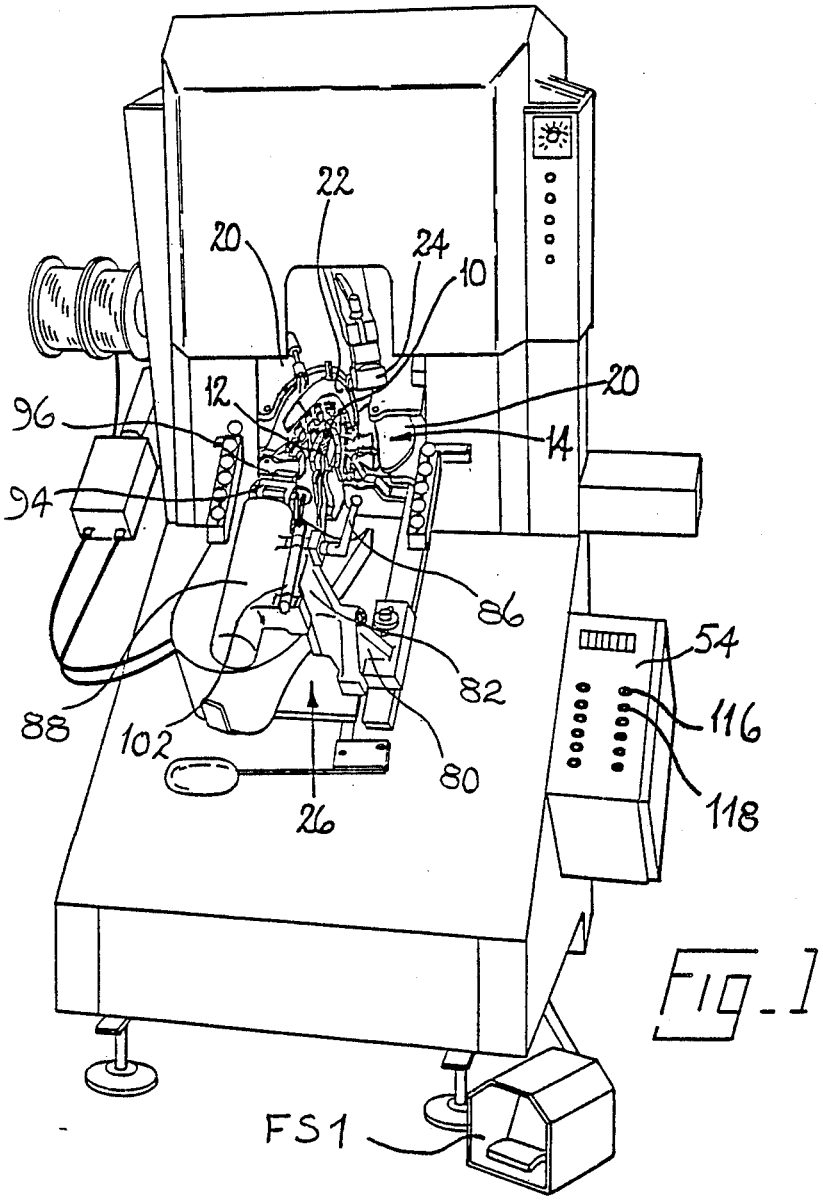
FIG. 1 is a perspective view of a pulling over and toe lasting machine forming part of the apparatus in accordance with the invention.

The apparatus in accordance with the invention now to be described comprises a pulling over and toe lasting machine (FIG. 1) of conventional design, except as hereinafter described. Thus, the machine comprises a shoe support 10, for supporting, bottom down, the forepart of a shoe, a generally U-shaped so-called imprinter plate 12 which can be pressed against marginal portions of the forepart of an insole of a shoe supported by the shoe support 10 and thus cause adhesive to be applied to said marginal portions, together with a pincer assembly generally designated 14, a wiper assembly comprising two wiper plates 20, a toe band 22, a toe pad 24 and a heel rest generally designated 26. The machine also comprises a control panel 54 and a foot switch FS1.

In addition, the apparatus in accordance with the invention comprises a side and heel seat lasting machine (FIG. 3) which is generally similar, except as hereinafter described, to the machine described in U.S. patent specification No. 4395790. Thus, the machine comprises a shoe support 30 for supporting, bottom uppermost, a shoe for side and heel seat lasting operations to be performed thereon, said support being mounted for movement, fore-and-aft of the machine, between a loading position and the operating locality of the machine. The machine also comprises a holddown 32, a wiper assembly generally designated 34 for lasting heel seat portions of the shoe, and two side lasting assemblies generally designated 36 (one only shown in FIG. 3) for lasting side portions of the shoe. In addition, the machine comprises adhesive-applying means generally designated 38 (omitted from FIG. 3 but shown in FIG. 4) for applying adhesive to upstanding lasting marginal portions of the upper of a shoe supported by the shoe support 30 prior to the operation of the heel seat wiper assembly 34 and side lasting assemblies 36.

Figure 3:
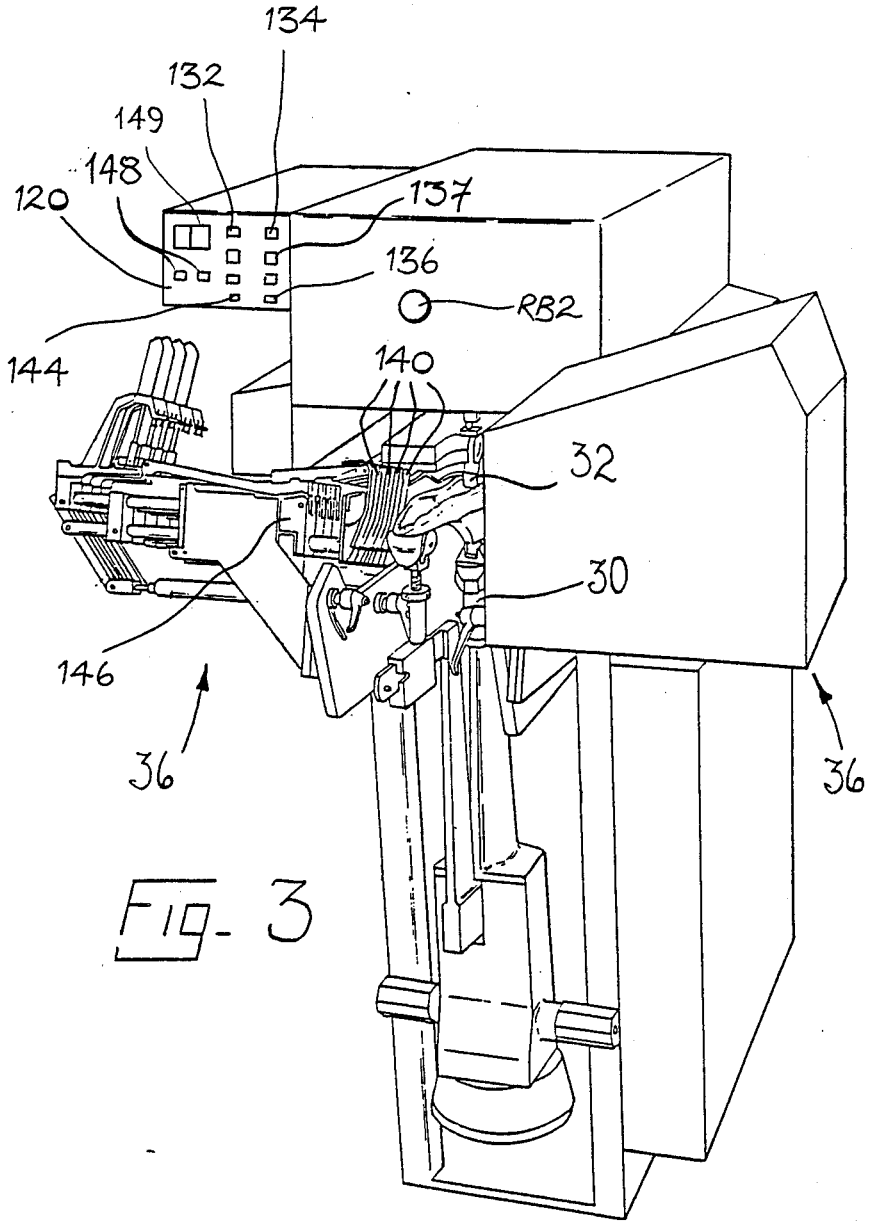
FIG. 3 is a perspective view of a side and heel seat lasting machine forming part of the apparatus in accordance with the invention.

More particularly, each side lasting assembly comprises a plurality of lasting elements 140 in the form of lasting straps each of which is supported at its upper end by two fingers, independently pivoted about axes extending transversely of the shoe bottom, and each of which is backed by a pad 142; each assembly comprises four such lasting elements (FIG. 3). For different shoe lengths, it will be appreciated, the number of such elements to be used will vary and the machine thus comprises means whereby one or more of the elements can be disabled, as will be referred to hereinafter. The adhesive-applying means 38 is generally similar to the arrangement described in UK Patent Specification No. 2118867 and comprises two nozzles 40 (FIG. 4) mounted for pivotal movement towards and away from one another, thus to be brought from a centrally disposed position into engagement with upstanding lasting marginal portions of a shoe upper as aforesaid, such outward movement being effected by pneumatic means (not shown). For determining the height of the nozzles in relation to the shoe upper to which adhesive is to be supplied thereby, the means 38 comprises a shoe bottom engaging member in the form of a skid 42 which is carried, for heightwise sliding movement in relation to the nozzles 40, by a piston rod 44 of a piston-and-cylinder arrangement 46 mounted on a bracket 48 itself carried by a support 50 for the nozzles 40. Means generally designated 52 is also provided for adjusting the heightwise movement of the skid in relation to the support 50, and thus in relation to the nozzles 40. The support 50 is itself supported on a carriage (not shown) which is movable by pneumatic motor means (not shown) fore-and-aft of the machine, thus to cause the nozzles 40 to track along opposite side portions of a shoe bottom as aforesaid. The heightwise position of the nozzles 40, as will be hereinafter referred to, is varied as they are caused to track along opposite marginal portions of the shoe upper as follows.

When applying adhesive to the heel seat portion of the shoe upper the lasting marginal portions have frequently been subjected to a previous backpart molding and seat flanging operation and consequently tend to lie relatively flat and close to the insole. In order to apply adhesive to this portion of the shoe upper, therefore, the nozzles have to be lowered in relation to the shoe bottom and this is achieved by retracting the skid 42 heightwise in relation to the nozzle support 50. Upon leaving the area which has been previously flanged as aforesaid, the nozzles 40 require to be raised, which is then achieved by lowering the skid 42 in relation to the nozzle support 50, and the nozzles are maintained at this height as they track along opposite side portions of the shoe toewardly along the waist region towards the ball region.

Figure 4:
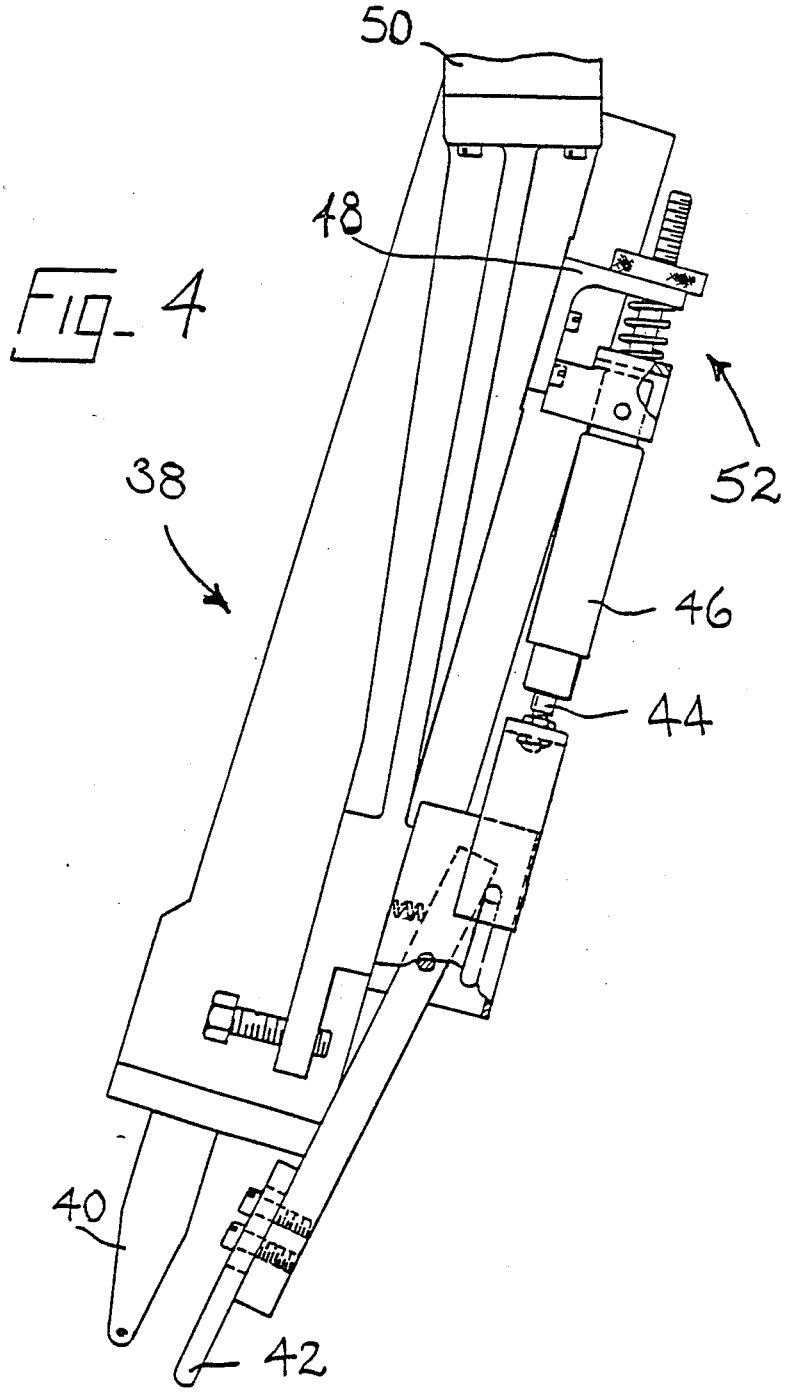
FIG. 4 is a fragmentary view showing details of the mounting of adhesive-applying nozzles of the machine of FIG. 3.
Figure 5:
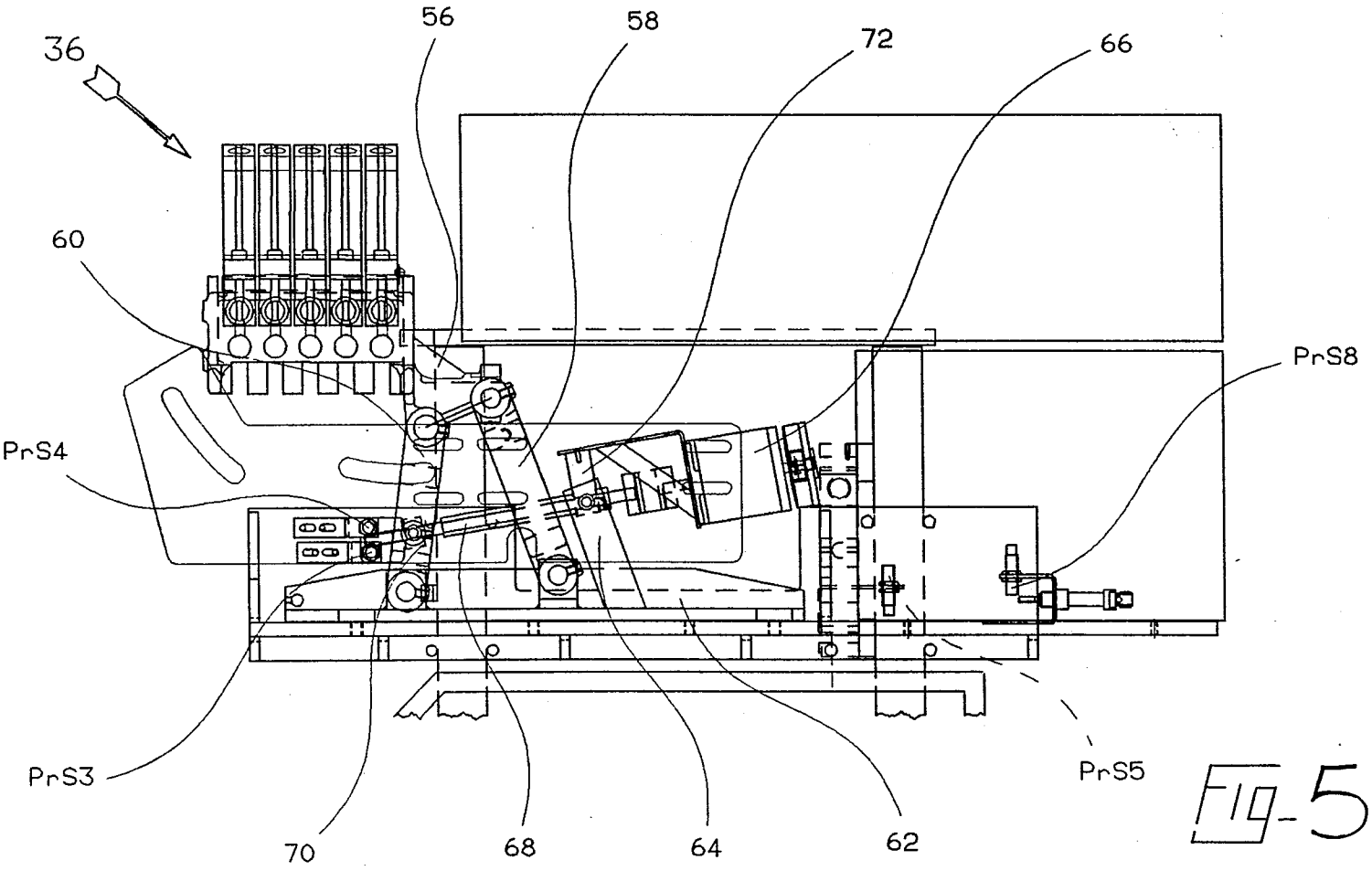
FIG. 5 is a fragmentary view showing details of a mechanism for tilting side lasting assemblies of the machine of FIG. 3.

As will be seen from FIG. 4, the nozzles precede the skid 42 as the assembly moves along the shoe bottom. Consequently, when the ball region is reached by the nozzles, especially in the case of a high-heeled shoe, the skid 42 is still "climbing". In order therefore to prevent the nozzles from being raised out of engagement with the shoe upper, because of the continued climbing movement of the skid 42, the skid is again retracted thus to lower the nozzles in relation thereto thereby retaining the nozzles in contact with the upper. In any event, at this stage, the nozzles are approaching the previously toe-lasted portion of the shoe and consequently there is again a tendency for the lasting marginal portions to lie progressively closer to the insole in this region.

It will of course also be appreciated that the nozzles require to be raised and lowered bodily in relation to the shoe bottom at the start and finish of an adhesive-applying operation and in particular the lifting of the nozzle support 50 at the end of the adhesive-applying operation will be determined according to the length of application (referred to herein as the "length of trace") required, this being a function of the length of the shoe and of the length of the shoe bottom portion which has been previously toe-lasted.

As has already been mentioned, in the case of high-heeled shoes the region from the heel breast line to the ball region is inclined to the heel seat of the shoe, and thus to the plane of the wiper assembly 34. In order to accommodate such angles of inclination, the side lasting assemblies 36 are mounted for pivotal movement about a notional axis which is coincident with the forward edge of the wiper plates, when the latter are in their most advanced position. To this end, each side lasting assembly comprises a casting 56 which is carried by two sets of links 58, 60 pivotally mounted on a base plate 62 secured to the machine frame. Also mounted on the base plate 62, in an upstanding bracket 64, is a stepping motor 66 having an output drive shaft 68 which is connected to a trunnion block 70 supported between the set of levers 60, the stepping motor 66 and its output drive shaft 68 being supported by a further trunnion block 72 for pivotal movement in the bracket 64. By operation of the stepping motor 66, the links 60 are caused to pivot whereby, through the connection with the pivotal links 58 the casting 56 and thus the side lasting assembly 36 is caused to pivot in the desired manner.

It will of course be appreciated that the side lasting assemblies are mounted independently of one another for such pivotal movement, each assembly being provided with its own stepping motor 66. Furthermore, associated with the output drive shaft of each stepping motor are two proximity switches PrS3, PrS4, constituting limit switches whereby the range of angular displacement of the assemblies 36 from the wiper plate is limited between 4° and 22°, as will be hereinafter referred to.

Figure 2:
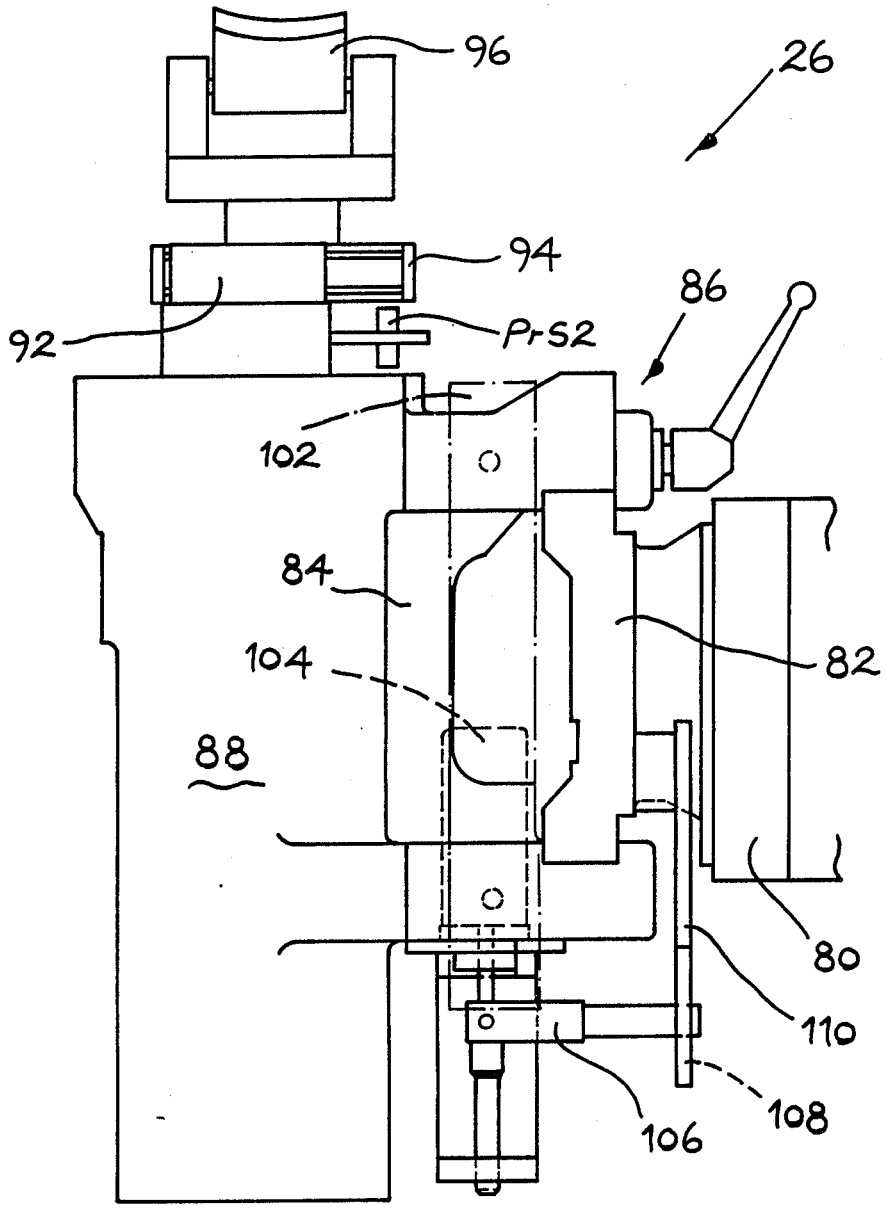
FIG. 2 is a fragmentary view showing details of a heel rest of the machine of FIG. 1.

In the apparatus in accordance with the present invention the setting of the heel rest 26 of the pulling over and toe lasting machine is utilized for automatically setting up the various requirements of the side and heel seat lasting machine, in particular the angle at which the side lasting assemblies are inclined to the wiping plane of the heel seat wiper assembly 34, the length of trace, adhesive shut-off and also the incidence of the heightwise movement of the skid 42 relative to the nozzles 40. For this purpose, the heel rest 26 comprises a bracket 80 (FIG. 2) mounted on the machine frame and supporting a guide 82 extending heightwise of the machine, in which guide a block 84 is mounted for heightwise sliding movement, a clamp arrangement 86 being provided for locking the block in adjusted heightwise position. Integral with the block is a piston-and-cylinder arrangement 88 on a piston rod of which is mounted a support block 92 in which is supported, for sliding movement transversely of the machine, a carrier 94 on which a heel block 96 is pivotally mounted. Integral with the support block 92 is a piston-and-cylinder arrangement (not shown) by which the carrier 94 can be moved transversely between a "left" and "right" position, in which the heel block 96 is positioned for operating on a left or a right shoe, as the case may be. In the operation of the machine actuation of the piston-and-cylinder arrangement 88 is effective to move the heel block 96 towards the shoe support 10 thus to engage the heel end of a shoe supported thereby; in this way, the heel block serves to hold the shoe in position on the shoe support 10.

For monitoring the amount of movement of the heel block in this manner, there is also mounted on the block 84 a transducer in the form of a linear potentiometer 102 the core of which is connected to the support block 96 (see FIG. 1); the linear potentiometer 102 thus constitutes first transducer means of the machine. The machine also comprises second transducer means in the form of a second linear potentiometer 104 which is mounted also on the block 84 and the core of which carries a pin 106 which is captive in an inclined slot 108 formed in an upstanding plate 110 secured to the slide guide 82. Thus, as the block 84 is moved heightwise along said guide, the pin, in moving heightwise in the slot, is along caused to be laterally displaced, thereby displacing also the core of the linear potentiometer 104. In this way, the heightwise movement of the block 84 is monitored proportionately by the linear potentiometer 104. It will of course be appreciated that the linear potentiometer 102 similarly monitors the movement of the heel rest towards and away from a shoe.

The pulling over and toe lasting machine also comprises, located on the control panel 54 of the machine, an operator-actuatable "cancel" button 116, details of the operation of which will be referred to hereinafter, and an operator-actuated button 118 whereby the operator can manually select a "left shoe" or a "right shoe" operation of the machine.

The pulling over and toe lasting machine further comprises a first sensing device in the form of a proximity switch (not shown, but referred to hereinafter by the reference numeral PrS1) which is associated with a piston-and-cylinder arrangement (also not shown) for effecting operating movement of the wiper plates 20 of the machine, said proximity switch being actuated when the wiper plates have completed their inwiping movement. In addition, the machine comprises a second sensing device, in the form of a second proximity switch PrS2, which is mounted on the block 92 of the heel rest 26 and monitors the movement of the carrier 94, thus indicating whether the shoe being operated upon is a left or a right. As will be described hereinafter, the proximity switch PrS1 constitutes actuator means of the machine in that it provides a "trigger" whereby the output value of each of the linear potentiometers 102, 104 and also the status of the proximity switch PrS2 are "read"; that is to say, the dimensions of the shoe are thus read when the heel rest is fully engaging the heel end of the shoe and no further lengthwise or heightwise movement thereof will be effected.

The side and heel seat lasting machine of the apparatus in accordance with the invention comprises electronic control means, more particularly microprocessor control means, by which the various setting and operating functions of the machine are controlled in response to the "readings" effected by the first and second transducer means 102, 104 and the proximity switch PrS2 of the pulling over and toe lasting machine. In particular, the various setting functions referred to hereinbefore, viz. the angle at which the side lasting assemblies are inclined to the wiping plane of the heel seat wiper assembly 34, the length of trace, adhesive shut-off and also the incidence of the height-wise movement of the skid 42 relative to the nozzles 40, are set up in accordance with these readings, as will be hereinafter described in detail with reference to FIGS. 7 to 11. It is however pointed out that the side and heel seat lasting machine also is capable of being used in a "manual" mode, selected by selector switch 130 which is mounted on a control panel 120 of the machine, in which case the various settings are made manually by means of switches 148 together with a digital display provided on the control panel 120, said switches also being used, as will be referred to hereinafter, manually to edit certain of the functions which are set automatically from the readings taken from the first and second transducer means 102, 104. In addition, it is to be noted that in the manual mode, those settings which are dependent upon the length of trace are calculated from the "manually" set length of trace value.

The movement of the carriage by which the nozzle support 50 is supported for movement fore-and-aft of the machine as aforesaid is monitored by further transducer means constituted by a linear potentiometer (not shown in FIGS. 3 and 4, but referred to with reference to the flow charts of FIGS. 7 to 10 as "146"). The linear potentiometer 146 is mounted on the machine frame adjacent the carriage and its core is connected to the carriage such that the movement of the carriage effects movement of the core, thus varying the output voltage of the potentiometer. The output value of the potentiometer is thus proportional to the movement of the carriage. In the operation of the machine the incidence of the various nozzle-related functions referred to above can be set, either automatically or manually, by setting comparator values with which the output value of the portentiometer is compared, the function being effected when a state of equality is sensed.

Figure 6:
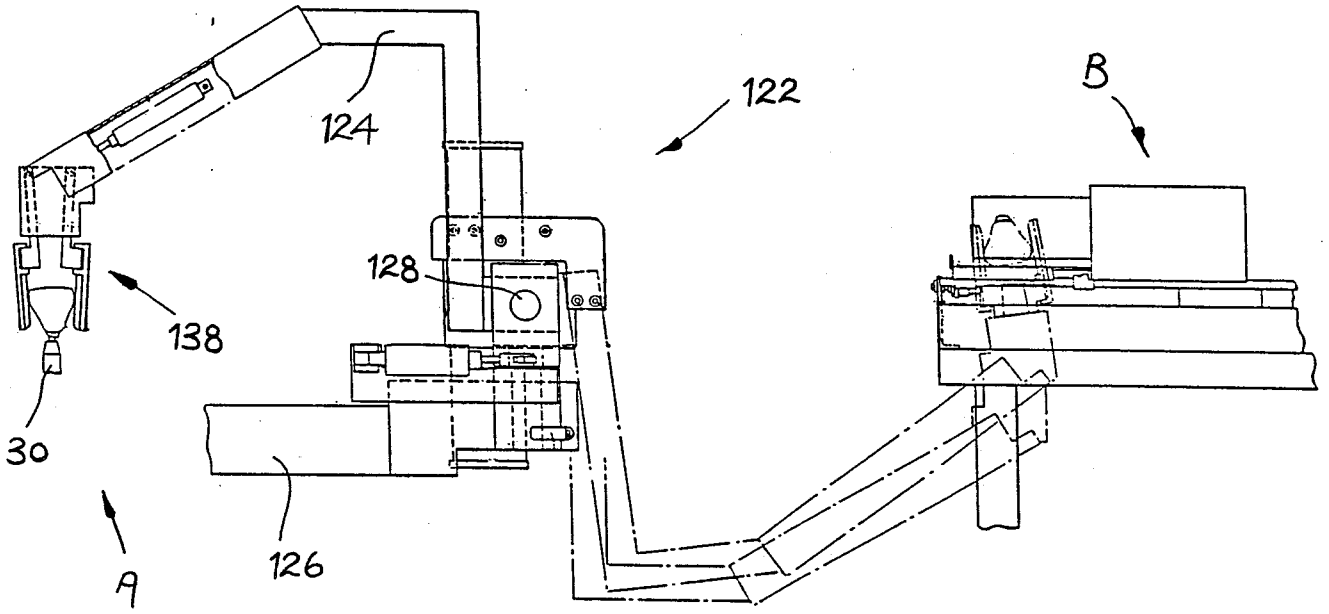
FIG. 6 is a view showing details of an automatic unloading device for use with the machine of FIGS. 3 to, 5.
Figure 7A:
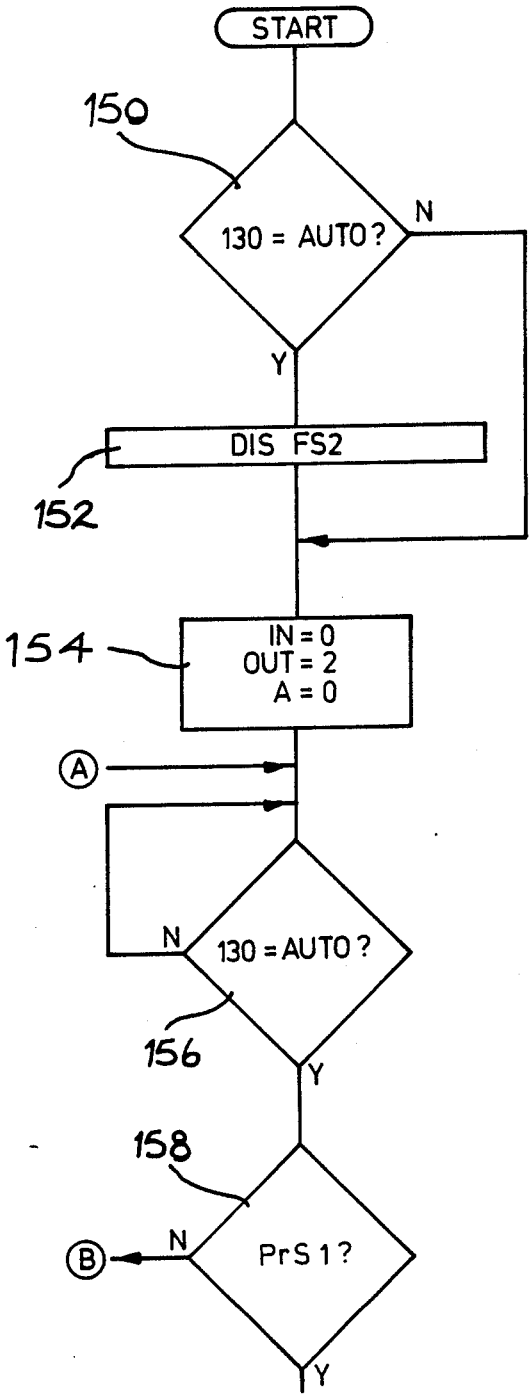
FIGS. 7 to 10 are flow charts setting out details of the electronic control of the operation of the apparatus in, accordance with the invention.
Figure 7B:
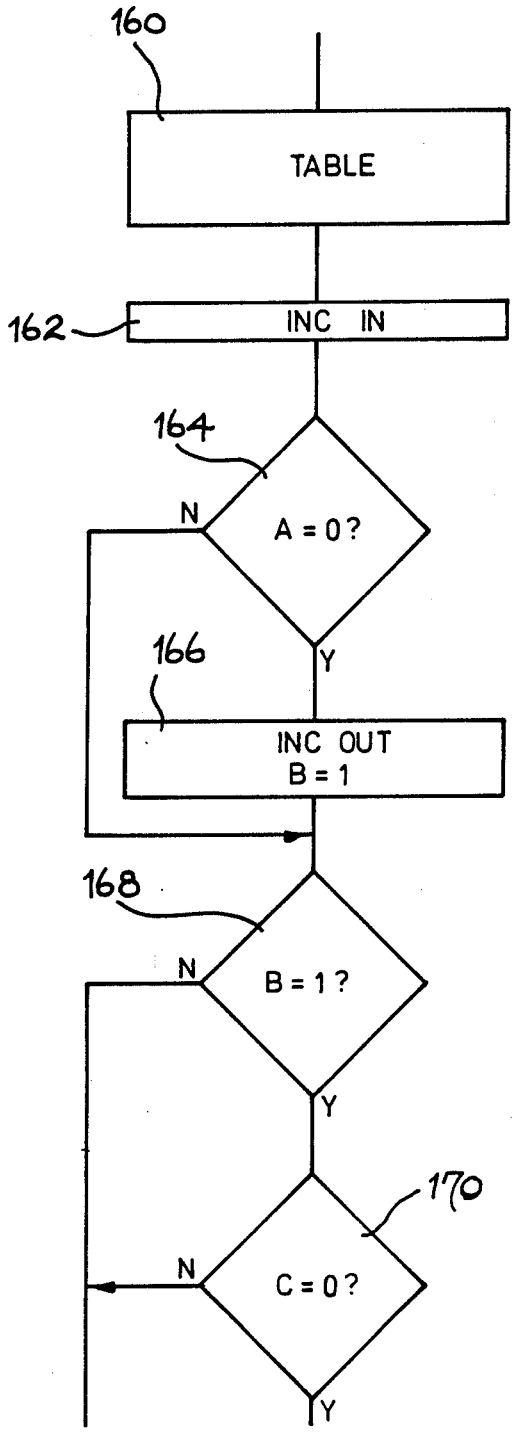
Figure 7C:
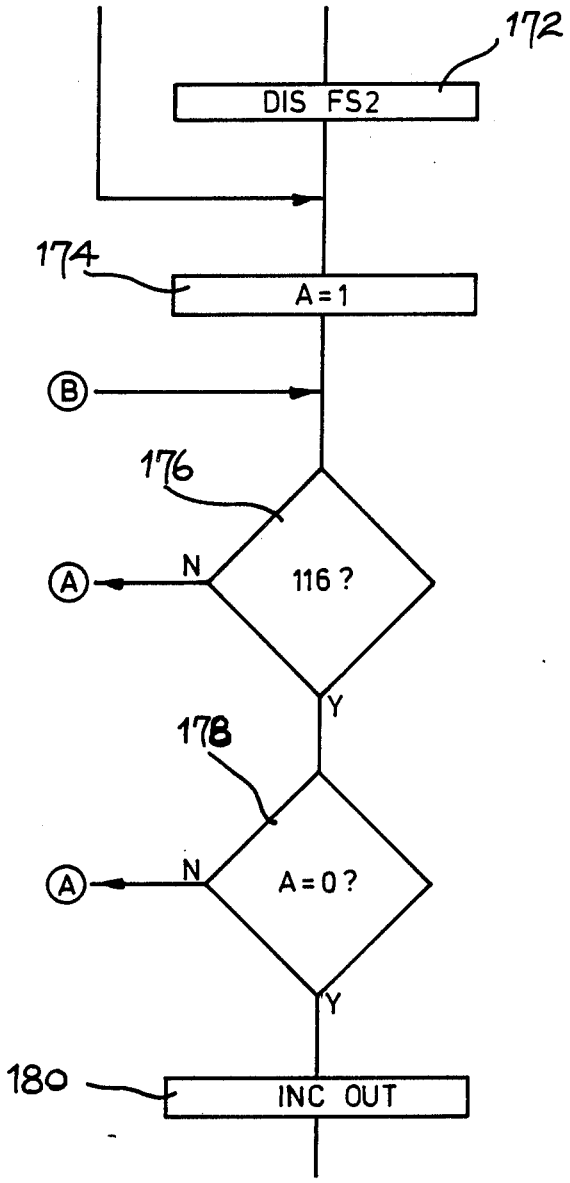
Figure 7D:
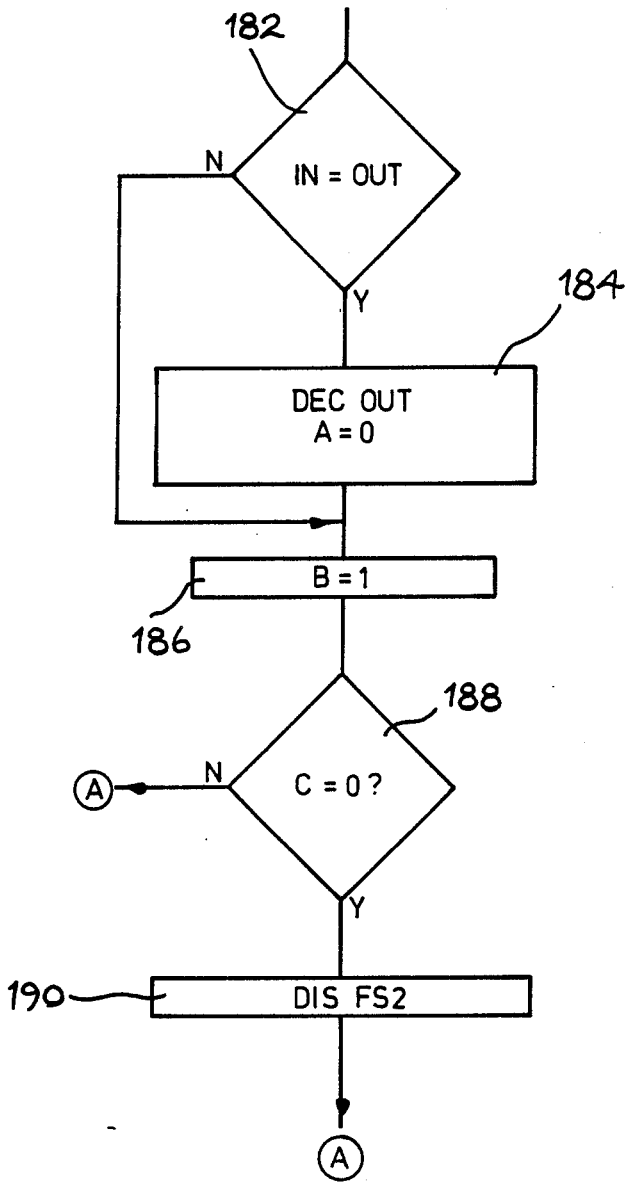

For enhanced automaticity, furthermore, the apparatus in accordance with the invention also comprises an automatic unloading device generally designated 122 (FIG. 6), which is generally similar, except as hereinafter described, to the device described in U.S. patent specification No. 4599759. Said device thus comprises an arm 124 mounted on a frame 126 connected to the frame of the side and heel seat lasting machine, for pivotal movement about an axis 128. The arm 124 carries at its remote end a pick-up arrangement generally designated 138 by which a shoe can be transferred from a pick-up station A, at which it is disposed adjacent the operating locality of the side and heel seat lasting machine, to a deposit station B, the shoe being turned upside down during such transfer. Further details of the operation of the device 122 will be described hereinafter.

FIG. 7 is a flow chart indicating the manner in which the microprocessor control means of the side and heel seat lasting machine scans the output of the first and second transducer means 102, 104 of the pulling over and toe lasting machine. As a general rule, the microprocessor control means will read information from the first and second transducer means 102, 104 and from the proximity switch PrS2 of the pulling over and toe lasting machine whenever a "data valid" signal is received from the proximity switch PrS1; it will be appreciated that the data valid signal is supplied each time the wiper plates 20 of the pulling over and toe lasting machine reach their over-wipe position. For storing the output value information the microprocessor control means has a memory which is in the form of a table having three locations at each of which a set of information can be stored (see FIG. 11). Each set of information thus comprises shoe length information (SL) corresponding to the output value of the first transducer means 102, heel height information (HH) corresponding to the output value of the second transducer means 104, and left/right information, corresponding to the status of the proximity switch PrS2. For "writing" to each location in turn the table is provided with an "IN" pointer which is incremented after each set of information has been written. For accessing each location an "OUT" pointer is provided which again is incremented after the side and heel seat lasting machine has been set up from the information as accessed.

In using the apparatus in accordance with the invention it is envisaged that at any stage the work in progress will comprise three shoes, namely a shoe being operated upon at the pulling over and toe lasting machine, a shoe which has just been operated upon by that machine and a shoe being operated upon by the side and heel seat lasting machine; hence the requirement for three locations in the table. It will also be appreciated that, during the normal course of working the IN pointer value will not be equal to the OUT pointer value, but the situation of equality will exist at certain stages, especially at the start of a working shift, as will be explained hereinafter. In addition the operator may wish to re-last a shoe either in the pulling over and toe lasting machine, for which purpose the "cancel" button 116 is provided, by which the sequence is broken, or in the side and seat lasting machine, for which purpose a "repeat" button 137 is provided on the control panel 120.

With specific reference now to FIG. 7, steps 150 to 154 relate essentially to the start of a working shift, and more particularly at step 150 the setting of the side and heel seat lasting machine to "automatic" or "manual" mode by switch 130 is established, the "start" treadle FS2 of said machine being disabled (step 152) where "automatic" is selected. At step 154 the IN pointer value is set to zero, the OUT pointer to two and a flag A is set to value zero; flag A will be set to zero during the operation of the apparatus only in circumstances where the apparatus is empty of shoes. This state will of course arise at the start of a working shift. It will of course be appreciated that the microprocessor control means cannot be allowed to read an empty location when a signal to set the side and heel seat lasting machine is received.

With the above settings made, and also in the normal operation of the apparatus, step 156 is then effected whereat the status of the automatic/manual switch 130 is again determined. If the machine is set to "manual" then this portion of the software merely loops, until the "automatic" mode is selected. Where the automatic mode is selected, the software then waits for a "data valid" signal to be supplied by the proximity switch PrS1 (step 158). Upon receipt of that signal, which it will be remembered is supplied when the wipers 20 of the pulling over and toe lasting machine reach their over-wipe position, the output value information of the first and second linear potentiometers 102, 104 and the status of the proximity switch PrS2 are written to the location indicated by the IN pointer (step 160), whereafter the IN pointer is incremented (step 162).

The next step (164) provides for the special case where the IN pointer and OUT pointer values are equal: in the case of an affirmative response to step 164 the OUT pointer is incremented, whereby the data in location zero is accessed, and at the same time a flag B is set to value one (step 166). Flag B indicates to other sections of the microprocessor control means that data is available and accessible for setting the side and heel seat lasting machine. In the normal course of working, where flag A will equal one (as will be observed later), step 166 is by-passed.

At step 168 the status of flag B is determined and at step 170 the status of a flag C is determined, this latter flag indicating, when its value equals zero, that no cycle of operation of the side and heel seat lasting machine is taking place. Assuming both steps 168 and 170 receive an affirmative answer, the treadle FS2 of the side and heel seat lasting machine is disabled (step 172); in the event of a negative answer to either question step 172 is by-passed. At step 174 flag A is set to value one, indicating that the system is no longer empty of shoes.

If no "data valid" signal has been received at step 158 then steps 160 to 174 are by-passed (via junction B), since there is no data at this stage to be written to a location of the table.

At step 176 the status of the "cancel" button 116 is determined. If it has not been actuated then the flow chart returns via junction A to step 156.

If the "cancel" button has been actuated, at step 178 the status of flag A is determined. If the value equals zero (which will only be the case if no "data valid" signal has been provided (since otherwise the value will have been set to 1 at step 174), then the software returns via junction A to step 156. If however its value equals one (as will usually be the case), then the software proceeds to step 180 at which the OUT pointer is incremented. It will be appreciated that in general the output value information which will next be accessed from the table will relate to the shoe which has completed its pulling over and toe lasting operation (as opposed to the shoe which is currently being operated upon by the pulling over and toe lasting machine). This is of course the shoe in respect of which the operator will perhaps wish to cancel the information stored so that it is not available for processing in the side and heel seat lasting machine. By incrementing the OUT pointer, therefore, that data is disregarded and the data for the next shoe (in this case the shoe currently being operated upon in the machine) will be accessed instead.

In general, incrementing the OUT pointer in this manner will not bring its value equal to that of the IN pointer (since there is usually an additional shoe "in hand"). In certain circumstances, however, e.g. where only one shoe has so far been operated upon, which situation may arise at the start of a working day or indeed at the start of a new rack of shoes, only one set of information may be stored in the table, so that incrementing the OUT pointer will move it to an empty location: this will result in the condition that the IN pointer and OUT pointer values are equal. This situation is investigated at step 182, and in the event of equality of these values the OUT pointer is decremented (so that it is not accessing an empty location) and also flag A is made equal to zero (step 184).

At the next step (186) flag B is set to equal one. Where at step 182 the values of the IN and OUT pointers are not equal, this means that the data which is available for setting the side and heel seat lasting machine will be that relating to the shoe currently being operated upon in the pulling over and toe lasting machine. Where on the other hand, the values are equal the accessible data will relate to the shoe in respect of which the "cancel" signal has been made. However, by setting flag A to equal zero, subsequently when step 164 is again reached, the route followed is via step 166 by which the OUT pointer is again incremented, thus enabling the location of the next shoe to be accessed.

At step 188 the inquiry is made as to whether the side and heel seat lasting machine has completed its operation and, in the event it has, the treadle FS2 is disabled. The flow chart then loops back to step 156 via junction A.

Figure 8A:
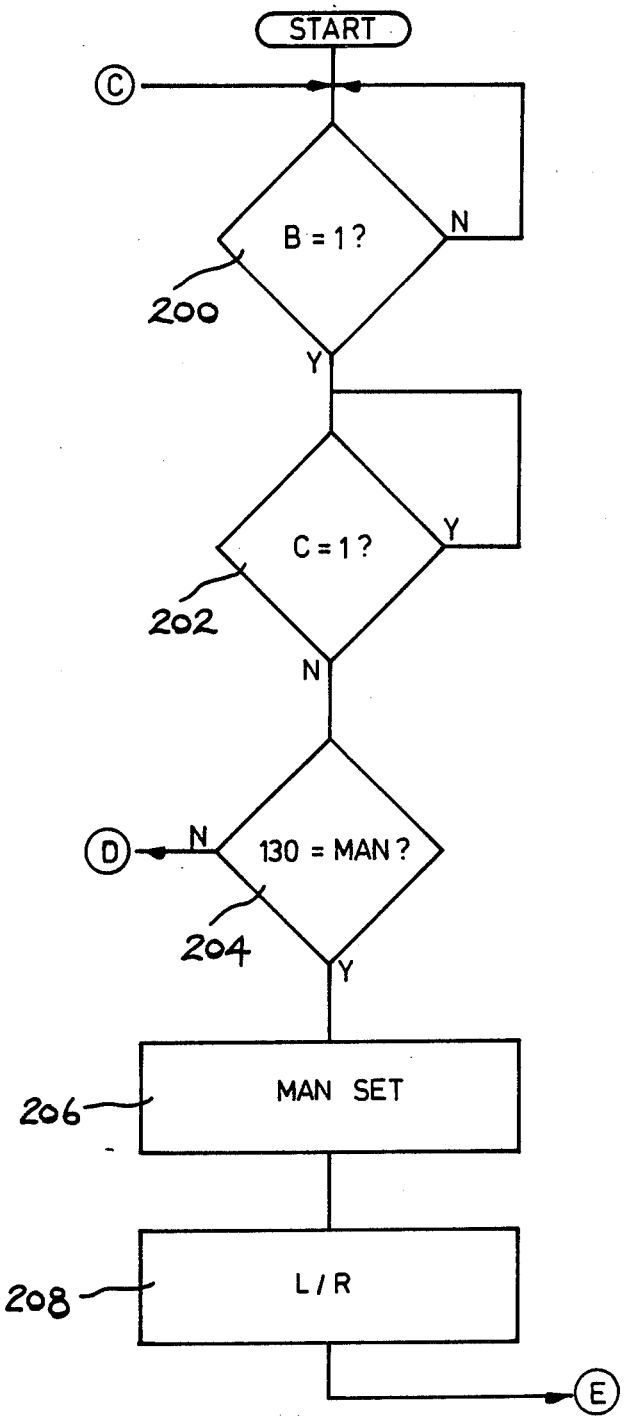
Figure 8B:
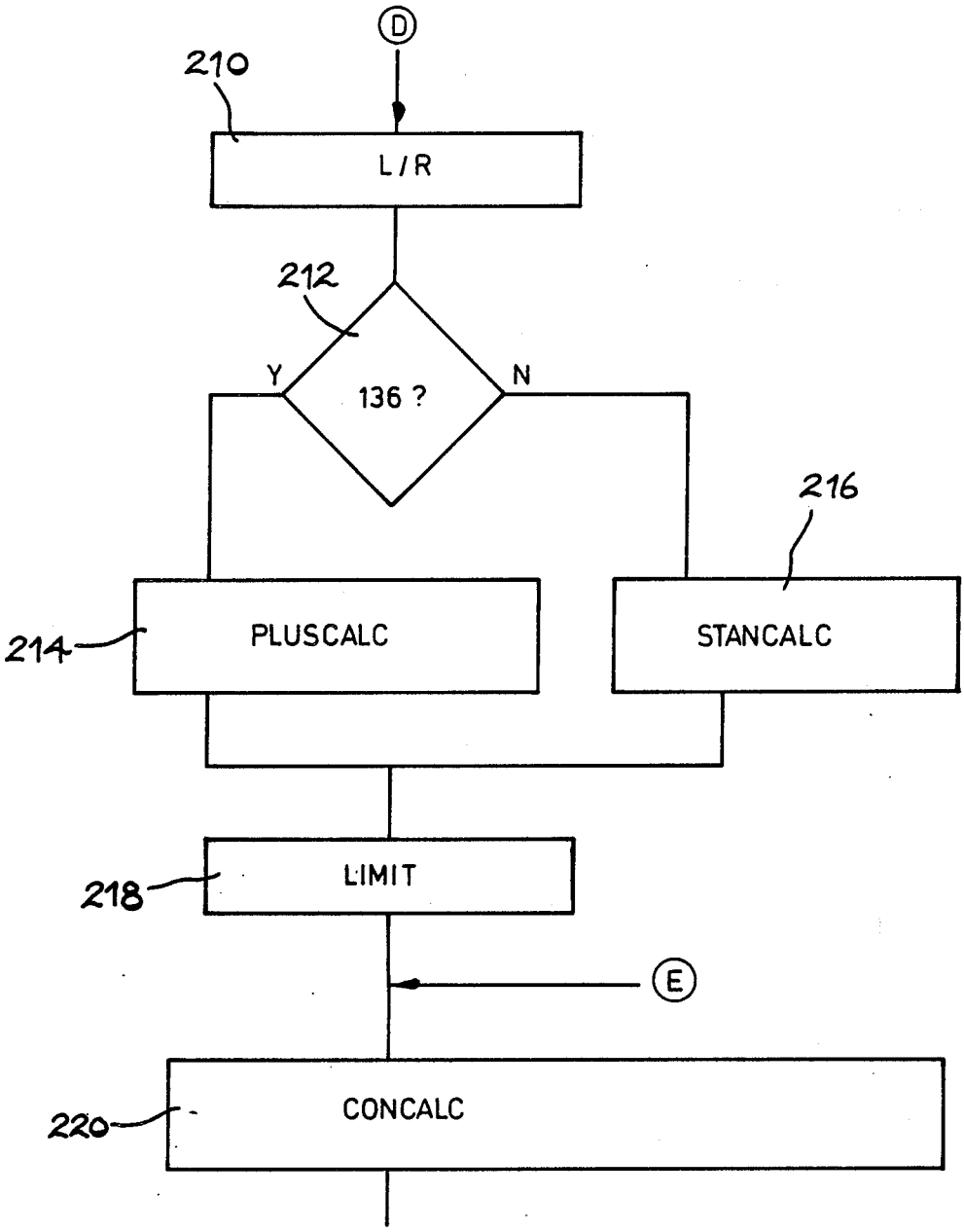
Figure 8C:
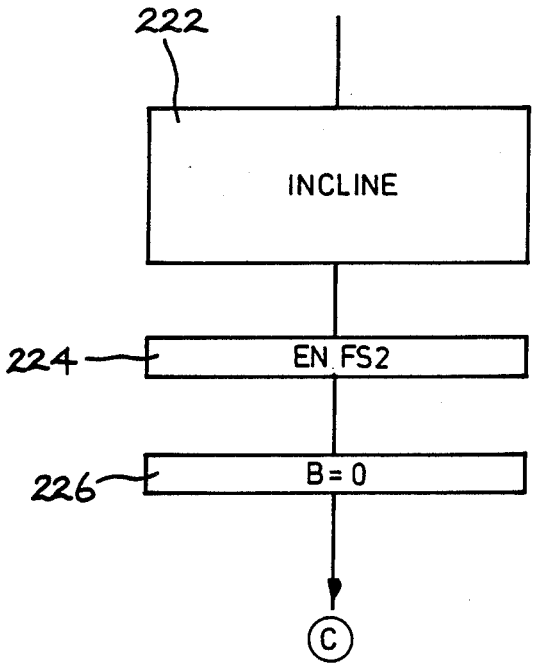

FIG. 8 relates to the setting-up of the side and heel seat lasting machine. At step 200 the status of flag B is determined. In the event that it does not equal one, indicating that no information has been accessed, the software merely loops until a value of one is found. At step 202 the status of flag C is determined, the software again continuing to loop until the previous cycle of operation is completed. At step 204 the status of the automatic/manual switch 130 is determined. If "manual" is selected then the operator is required manually, by means of the switches 148 and digital display 149 on the control panel 120, to input the desired angle at which the side lasting assemblies are to be inclined, the length of trace of the adhesive, and the position at which the nozzles 40 are to be lowered as they approach the ball region of the shoe (step 206). At step 208 the left/right setting of the shoe support 30 of the side and heel seat lasting machine is also set; this may be carried out automatically (by selection of an "automatic left/right" button 132 on the control panel on the machine) or may be selected for each operation by a "manual left/right" button 134 thereon.

In the case of switch 130 being set to "automatic" firstly the shoe support of the side and heel seat lasting machine is set according to the data in the table (step 210) followed by a calculation of the angle of inclination of the side lasting assemblies, the length of trace and the "nozzle down" position. In respect of these calculations, two different paths may be followed and to this end the status of a switch 136 on the control panel 120 is determined at step 212, said switch being set according to whether, in the pulling over and toe lasting operation, the adhesive-applying means 12 applies adhesive only to forepart portions just short of the ball region of the shoe or alternatively applies adhesive over the ball of the shoe. In the latter case (step 214) the angle of inclination of the side lasting assemblies is calculated on the basis of the height of the shoe (above the wiper plane) at the ball region thereof and the length of trace is calculated on the basis of the distance of the ball region of the shoe from the heel end thereof. In the former case, where the length of trace is determined according to the length of the imprinter plate 12 of the pulling over and toe lasting machine, it is necessary to input the length of said imprinter plate and the length of trace is calculated accordingly, while the angle of inclination of the side lasting assemblies is determined according to the height of the shoe part-way between the ball region and the end of the trace (step 216). In each case, the values on which the calculations are based are to be found at the location which is indicated by the OUT pointer.

Although not shown in the flow chart, it is possible for the operator to vary the automatic settings using the switches 148 on the control panel 120 of the side and heel seat lasting machine, and such variation values are thereafter summed with the calculated values for each function which is varied in this manner.

As has already been mentioned, the side lasting assemblies 36 are pivotable through a range of four to twenty two degrees (4° to 22°) to the wiping plane. Any setting outside this range, as sensed by the proximity switches PrS3, PrS4, is automatically prohibited (step 218).

Whether the "automatic" or "manual" mode settings have been provided for, in both cases the following positions are thereafter calculated at step 220: adhesive shut-off position (which is fixed by the of trace), the "nozzle raise" position (which is a constant distance from the start position of the nozzles) and also the number of lasting elements 140 by which the side lasting operation is to be effected (this being fixed by the length of trace and also the angle at which the assemblies are inclined).

With all the settings made, at step 222 the side lasting assemblies 36 are moved to the required angle, the status of the proximity switches PrS3, PrS4 being interrogated. Again though not described in the flow chart, where the movement to its pre-set position of either side lasting assembly is outside the prescribed range (despite the limit imposed by step 218), a "re-set" button 144 flashes on the control panel 120 and, upon actuation thereof, the two side lasting assemblies are moved to their datum position (referred to above) and are then moved to the pre-set position. At step 224 the treadle FS2 of the side and heel seat lasting machine is enabled and at step 226 flag B is set to equal zero. Thereafter the flow chart loops back via junction C to step 200. It will of course be appreciated that this section of the software then loops until flag B is again set to equal one, indicating a requirement for further pre-setting.

Figure 9A:
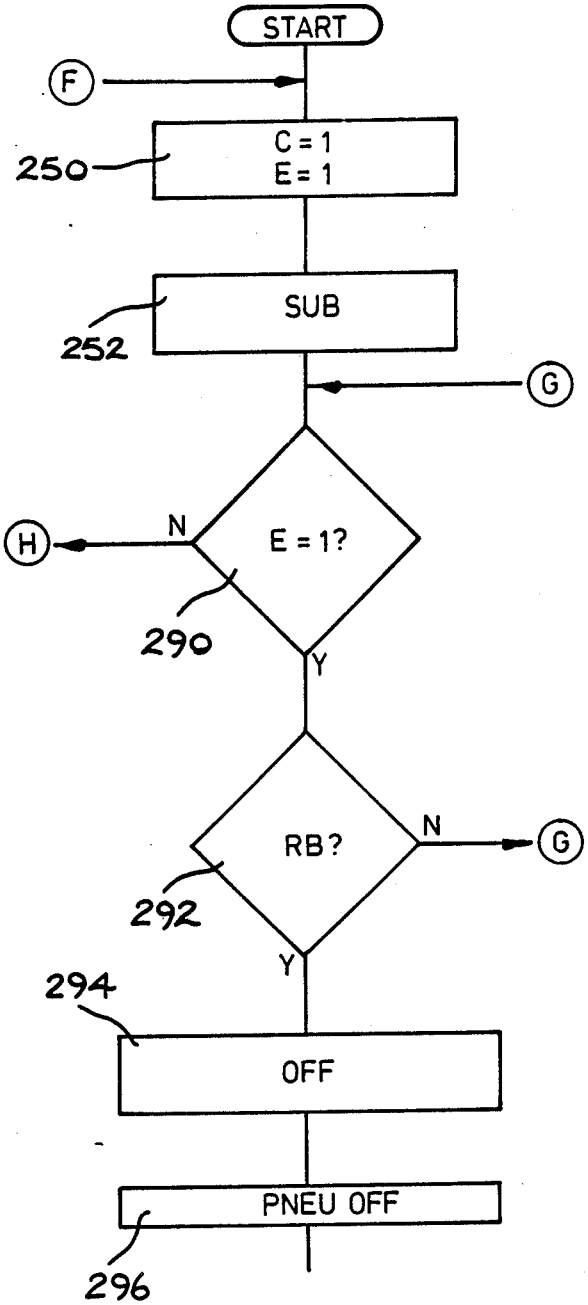
Figure 9B:
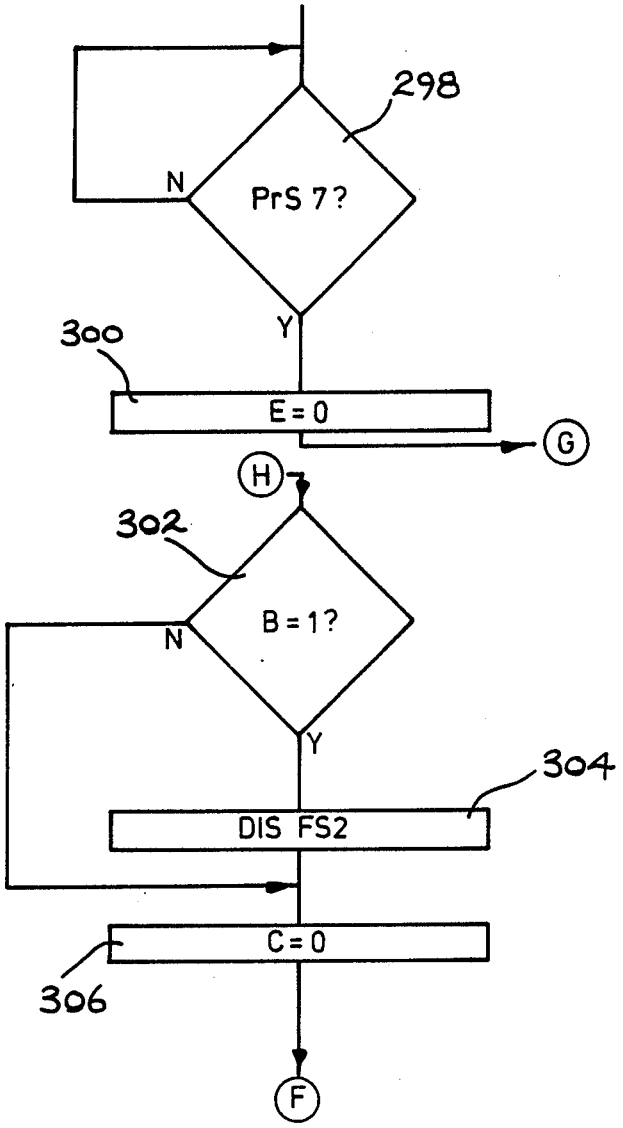
Figure 10A:
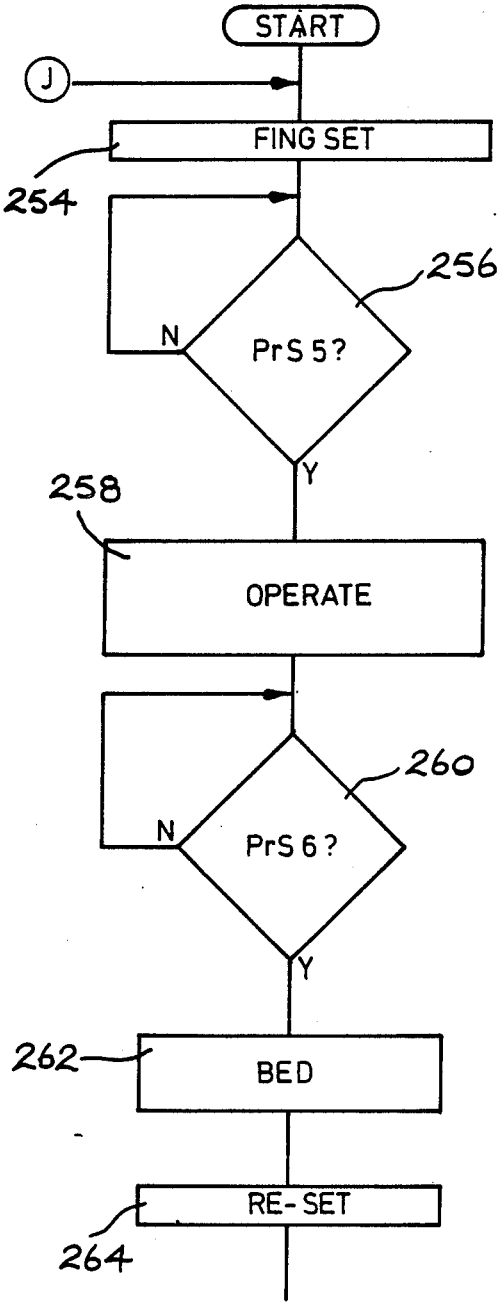
Figure 10B:
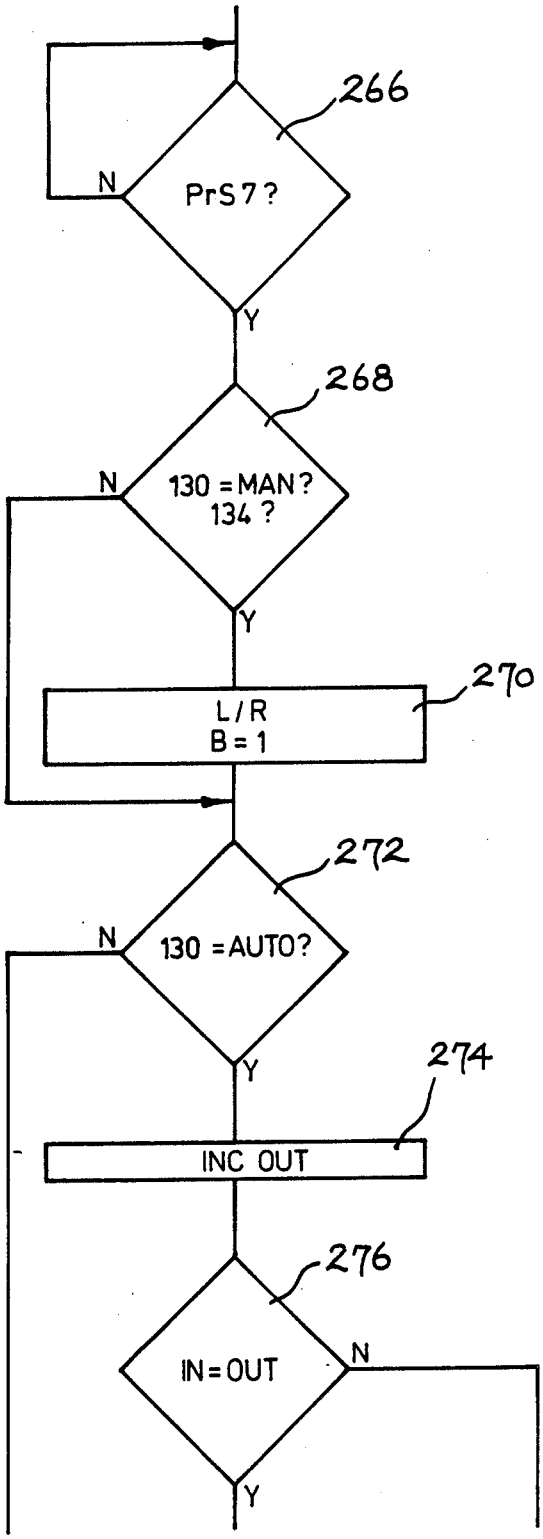
Figure 10C:
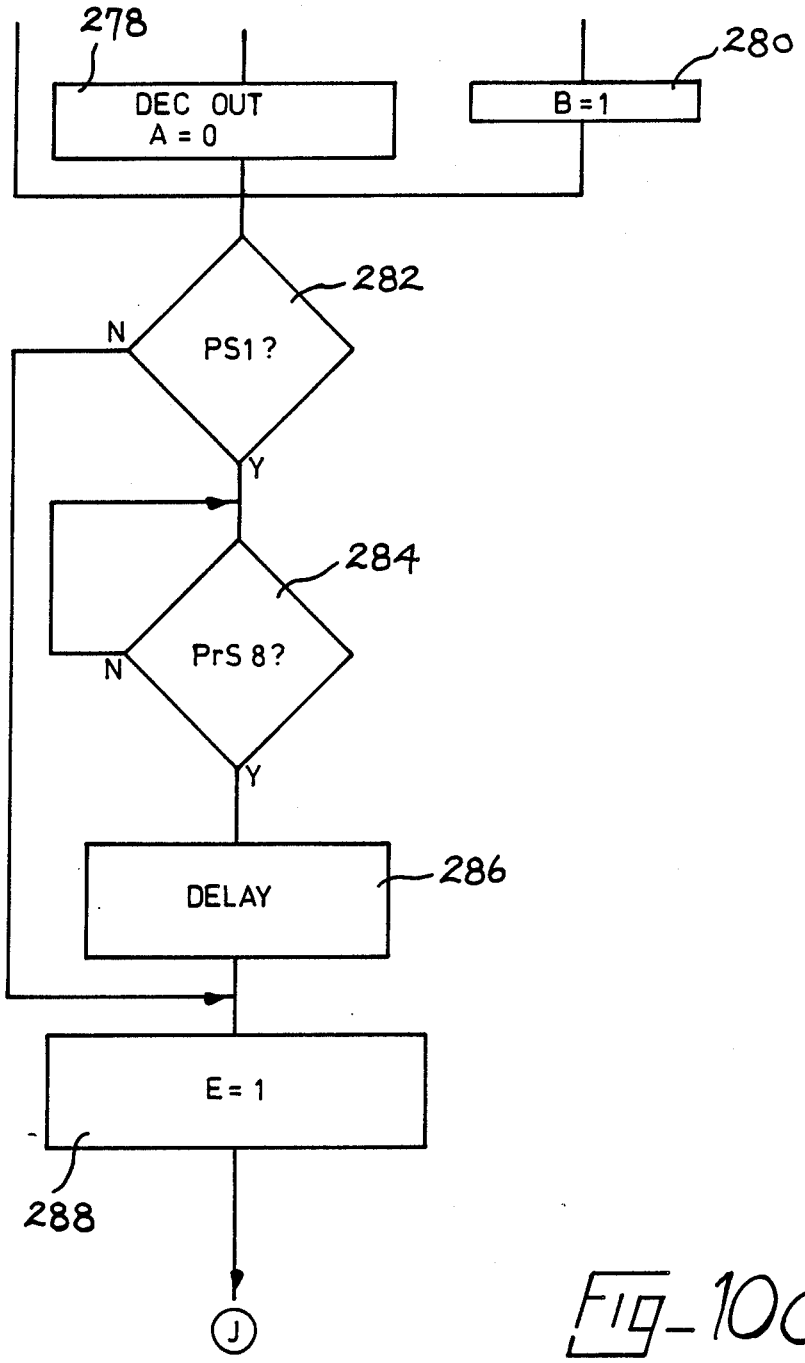
Figure 11:
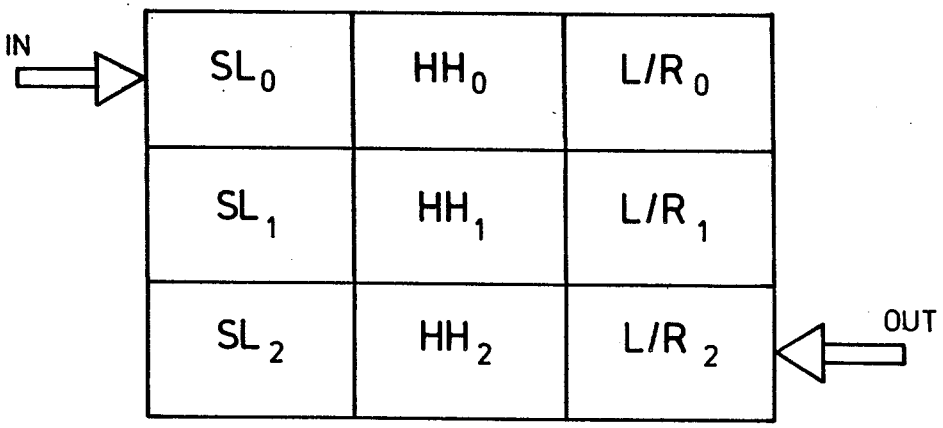
FIG. 11 is a diagrammatic representation of a table forming part of software by which the operation of the apparatus is controlled.

FIGS. 9 and 10 relate to two inter-connected flow charts for controlling the actual operation of the side and heel seal lasting machine. Referring first to FIG. 9, at step 250 flag C is set to a value one and a further flag D is also set to a value one both thus indicating that a cycle of operation of the machine is in progress. At step 252 the flow chart switches to the flow chart of FIG. 10 initiating the cycle of operation proper and effecting the settings which have previously been pre-set in accordance with the flow chart of FIG. 8. Thus, at step 254 (FIG. 10) the lasting elements to be actuated are set, namely by rendering inactive the pneumatic motor means of those not required. At step 256 a proximity switch PrS5, which senses when the carriage on which the nozzles are supported has moved to its most rearward position, is interrogated to determine whether the nozzles 40 have been moved to the heel end of the shoe, this interrogation looping until the nozzles reach the desired position. Upon the nozzles reaching said position the adhesive-applying means is actuated to carry out the following steps in a pneumatic sequence controlled by the linear potentiometer 146 (step 258): the adhesive is switched on, the nozzles, in a lowered condition, are moved through the heel seat region of the shoe, are then raised and continue to track along opposite sides of the shoe towards to ball region whereat they are again lowered, and finally the nozzles are raised out of engagement with the shoe bottom according to the pre-set length of trace, the adhesive being shut off at a predetermined distance from the end of the trace. At the same time (though not indicated in the flow chart) the seat wipers of the side and heel seat lasting machine are advanced. The status of a proximity switch (not shown, but referenced PrS6), by which the wiper advance to over-wipe position is detected, is interrogated at step 260, this step also looping until the wipers reach that position. When that position is reached, bedding pressure is applied (step 262) for a predetermined period and thereafter the various pneumatic components of the machine are re-set (step 264).

At this stage the shoe support 30 is returned to its loading position, this being sensed by a further proximity switch (not shown, but referenced PrS7) (step 266), at which step the software loops until the presence of the shoe support is sensed. Thereafter, at step 268, if both the switch 130 is set to "manual" and also "automatic left/right" (switch 132) has been selected, then an appropriate pre-setting for the switching of the shoe support 30 to the opposite hand of shoe is made, and at the same time flag B is set to value one (step 270). As will be explained hereinafter, the switching of the shoe support does not take place at this time. Unless both the conditions exist, step 270 is by-passed.

At step 272 the status of the automatic/manual mode switch 130 is again determined and, if "automatic" is selected, the OUT pointer is incremented (step 274) and the values of the IN pointer and OUT pointer are compared (step 276). If these values are equal (indicating that the system is empty of shoes) then the OUT pointer is decremented and flag A set to value zero (278). If they are not equal (which will usually be the case) then flag B is set to value one (step 280). Decrementing the OUT pointer as aforesaid (as has previously been discussed) ensures that at no time does the OUT pointer access an empty location in the table.

At step 282 the question is asked whether the automatic unloading device 122 is switched to "automatic" mode. For this purpose a pressure switch (not shown, but referenced PS1) is incorporated in a pneumatic circuit of the device and is supplied with air under pressure when an "automatic" mode of operation of the device is selected. In addition, it is pointed out that, upon operation of the device being initiated to unload a shoe from the shoe support 30, a pneumatic cylinder 148 (FIG. 4) mounted on the frame of the side and heel seat lasting machine is actuated and in response thereto a proximity switch PrS8 is actuated, indicating that movement of the transfer arm 124 has been initiated. In the event that "automatic" mode has been selected, therefore, the proximity switch PrS8 is interrogated at step 284, this step looping until movement of the arm is sensed. When this occurs, step 286 introduces a delay to allow the shoe to be removed from the shoe support 30 by the device prior to the support being re-set in accordance with an automatic left/right signal.

If no automatic unloading device is fitted or, though fitted, it is not in its "automatic" mode, then steps 284 and 286 are by passed. Thereafter flag D is set to value zero (step 288), indicating the end of the machine cycle.

While the flow chart of FIG. 10 is being thus followed, the flow chart of FIG. 9 continues a monitoring function. In particular, at step 290 the status of flag D is monitored; this was set to value one at step 250. While it remains at that value the flow chart at FIG. 9 merely monitors the status of a release button RB2 of the side and heel seat lasting machine (step 292) and, in the event that it is not actuated, loops vis junction G to step 290. If the release button is actuated, then the machine is switched off and the procedure which is the subject of the flow chart of FIG. 10 is re-set (step 294). At the same time step 296 re-sets the pneumatic controls and step 298 monitors the movement of the shoe support 30 to its initial, loading, position, flag D being re-set to value zero when this occurs (step 300), whereafter the software returns via junction G to step 290.

When flag D is set to value zero, either in response to the operation of release switch RB2 or the end of the cycle of operation, the software via junction H addresses step 302, interrogating the status of flag B. In general this will be set to a value one, which thereupon disables the foot switch FS2 until all the pre-setting of the machine is completed (step 304). If flag B equals zero, then step 304 is by-passed. At step 306 flag C is set to value zero and the software returns via junction F to step 250.

It will of course be appreciated that while the side and heel seat lasting operation is taking place, the other software activities may also be taking place, in particular the writing to the table (FIG. 11) of further shoe data in response to a pulling over and toe lasting operation being effected and indeed the pre-setting procedure as set out in FIG. 8.

As mentioned above, the operator may wish to repeat a side and heel seat lasting operation and for this purpose the "repeat" button 137 is provided. Although not referred to in the flow charts, the status of this button is determined only in circumstances where no automatic transfer device is fitted or the device is not switched to "automatic" mode, so that the operator may inspect the shoe prior to its removal to the next shoemaking operation. When the status of the button is thus determined, and this determination will take place following step 288 (FIG. 7), if the button has been actuated, to indicate that a "repeat" operation is required, then, if manual setting (switch 130) and automatic left/right (switch 132) have been selected, the pre-setting of the automatic left/right switching of the shoe support 30 is cancel led, the shoe support 30 remaining at its setting as for the preceding operation, while if automatic setting (switch 130) has been selected, the OUT pointer, which was incremented at step 274, is once more decremented.

It is envisaged that as a general rule the switch 130 will be set to "automatic", "manual" being selected only by way of interrupting the flow of work through the apparatus. Thus upon "manual" being selected, the OUT pointer remains in position as determined in the last "automatic" cycle, so that upon the switch 130 being returned to "automatic", the setting is made for the shoe which comes next in line from the pulling over and toe lasting machine. Similarly, when the side and heel seat lasting machine has been manually set, those manual settings are stored in the computer memory when the switch 130 is switched to "automatic".

We claim:

1. Apparatus for lasting toe, side and heel seat portions of a shoe, comprising a pulling over and toe lasting machine and a side and heel seat lasting machine, wherein the pulling over and toe lasting machine comprises first transducer means for monitoring the movement of a heel end engaging support member of the machine relative to a toe support thereof, second transducer means for monitoring adjustment movement of said heel end engaging member heightwise of the machine, and actuator means whereby, when wiper plates of a wiper assembly of said machine reach a predetermined position in their inwiping movement, the output value of each of the first and second transducer means is "read", and wherein the side and heel seat lasting machine comprises two side lasting assemblies each of which can tilt in a direction lengthwise of a shoe supported by a shoe support of said machine, to accommodate to the spring of the last of the shoe to be operated upon, adhesive-applying means comprising two nozzles arranged to track along opposite side portions of the shoe thus supported, first motor means for driving the nozzles as aforesaid, second motor means for effecting tilting movement of the side lasting assemblies, and computer control means which receives the output value information from the first and second transducer means of the pulling over and toe lasting machine and in accordance therewith, in a cycle of operation of the side and heel seat lasting machine, causes the second motor means to be actuated to set the angle of tilt of the side lasting assemblies and causes the distance to be set through which the nozzles are driven by the first motor means.

2. Apparatus according to claim 1 wherein the computer control means is also effective, in accordance with the output value information received from the first and second transducer means, to switch off the flow of adhesive to the nozzles.

3. Apparatus according to claim 1 wherein means is provided for maintaining the nozzles spaced from the shoe bottom by a distance which can be varied as the nozzles track along opposite sides of the shoe, and wherein the computer control means is effective, in accordance with the output value information received from the first and second transducer means of the pulling over and toe lasting machine, to cause such variation to take place at predetermined points along the path of the nozzles.

4. Apparatus according to claim 3 wherein the computer control means is also effective, in accordance with the output value information received from the first and second transducer means, to switch off the flow of adhesive to the nozzles.

5. Apparatus according to claim 1 wherein manually operable input means is also provided for inputting to the computer control means information relating to the lengthwise dimension of adhesive-applying means of the pulling over and toe lasting machine, such information together with the output value information received from the first and second transducer means of said machine serving to determine the distance through which the nozzles of the side and heel seat lasting machine are caused to track as aforesaid.

6. Apparatus according to claim 5 wherein the manually operable input means enables the input selectively of either a specific lengthwise dimension or of an instruction to calculate the appropriate lengthwise dimension using a program relating such dimension proportionately to the length of the shoe as determined according to the output information received from the first and second transducer means.

7. Apparatus according to claim 3 wherein manually operable input means is also provided for inputting to the computer control means information relating to the lengthwise dimension of adhesive-applying means of the pulling over and toe lasting machine, such information together with the output value information received from the first and second transducer means of said machine serving to determine the distance through which the nozzles of the side and heel seat lasting machine are caused to track as aforesaid.

8. Apparatus according to claim 7 wherein the manually operable input means enables the input selectively of either a specific lengthwise dimension or of an instruction to calculate the appropriate lengthwise dimension using a program relating such dimension proportionately to the length of the shoe as determined according to the output information received from the first and second transducer means.

9. Apparatus according to claim 7 wherein the computer control means is also effective, in accordance with the output value information received from the first and second transducer means, to switch off the flow of adhesive to the nozzles.

10. Apparatus according to claim 9 wherein the manually operable input means enables the input selectively of either a specific lengthwise dimension or of an instruction to calculate the appropriate lengthwise dimension using a program relating such dimension proportionately to the length of the shoe as determined according to the output information received from the first and second transducer means.

11. Apparatus according to claim 1 wherein each side lasting assembly of the side and heel seat lasting machine comprises a plurality of lasting members arranged side-by-side along the length of the side portion of a shoe to be operated upon, and wherein, in accordance with the output value information received from the first and second transducer means of the pulling over and toe lasting machine, only as many such members are actuated as correspond to the distance through which the nozzles are caused to track as aforesaid.

12. Apparatus according to claim 11 wherein manually operable input means is also provided for inputting to the computer control means information relating to the lengthwise dimension of adhesive-applying means of the pulling over and toe lasting machine, such information together with the output value information received from the first and second transducer means of said machine serving to determine the distance through which the nozzles of the side and heel seat lasting machine are caused to track as aforesaid.

13. Apparatus according to claim 12 wherein the manually operable input means enables the input selectively of either a specific lengthwise dimension or of an instruction to calculate the appropriate lengthwise dimension using a program relating such dimension proportionately to the length of the shoe as determined according to the output information received from the first and second transducer means.

14. Apparatus according to claim 12 wherein the computer control means is also effective, in accordance with the output value information received from the first and second transducer means, to switch off the flow of adhesive to the nozzles.

15. Apparatus according to claim 1 wherein the heel end engaging support member of the pulling over and toe lasting machine can be positioned according to whether the shoe to be supported in the machine is a left or a right, sensing means being provided for sensing in which position said member is located and the actuator means causing the status of said sensing means also to be read, and wherein the shoe support of the side and heel seat lasting machine can also be positioned for supporting a left or a right shoe under the control of the computer control means in accordance with the status, as read, of the sensing means.

16. Apparatus according to claim 15 also comprising an automatic unloading device whereby a finished shoe can be removed from the shoe support of the side and heel seat lasting machine, inhibiting means being provided for delaying the left/right setting of the shoe support of the side and heel seat lasting machine for the next operating cycle thereof to allow for the removal of the finished shoe.

17. Apparatus according to claim 16 wherein switch means is provided for selecting a manually initiated mode of operation of the unloading device, selection of such mode being effective to disable the inhibiting means.

18. Apparatus according to claim 15 wherein each side lasting assembly of the side and heel seat lasting machine comprises a plurality of lasting members arranged side-by-side along the length of the side portion of a shoe to be operated upon, and wherein, in accordance with the output value information received from the first and second transducer means of the pulling over and toe lasting machine, only as many such members are actuated as correspond to the distance through which the nozzles are caused to track as aforesaid.

19. Apparatus according to claim 1 wherein the computer control means comprises a memory in the form of a table having a plurality of addresses in which output value information received in response to operation of the actuator means in respect of successive shoes is stored in sequence, together with means for accessing each such address in sequence and setting up the side and heel seat lasting machine accordingly.

20. Apparatus according to claim 19 wherein operator-actuatable canceling means is provided whereby, in the event that a shoe in respect of which output value information has been stored in one of the addresses of the memory table as aforesaid is not passed to the side and heel seat lasting machine, the address next in sequence to said one address is next accessed for setting up the side and heel seat lasting machine.

21. Apparatus according to claim 20 wherein operator-actuatable "repeat" means is provided whereby, after an operating cycle of the side and heel seat lasting machine has been effected in accordance with the output value information stored in one of the addresses of the memory table, the same address can again be accessed for the next operating cycle of the machine.

22. Apparatus according to claim 1 wherein the computer control means stores the output value information received from the first and second transducer means for use in carrying out the next operating cycle of the side end heel seat lasting machine, and wherein operator-actuatable canceling means is provided whereby in the event that a shoe operated upon by the pulling over and toe lasting machine is not passed to the side and heel seat lasting machine in sequence the operator can cancel the stored information.

23. Apparatus according to claim 22 wherein operator-actuatable "repeat" means is provided whereby, after an operating cycle of the side and heel seat lasting machine has been effected in accordance with the output value information stored in one of the addresses of the memory table, the same address can again be accessed for the next operating cycle of the machine.

24. Apparatus according to claim 1 wherein the side and heel seat lasting machine has selector means whereby an "automatic" operating mode can be selected, in which the machine is set up in accordance with the output value information received from the first and second transducer means, or a "manual" operating mode can be selected, in which the machine is set up using operator-settable machine control means, and wherein, in the event that a manual operating mode is selected, the last-received output value information received from the first and second transducer means is stored until an automatic operating mode is thereafter selected.

25. Apparatus according to claim 22 wherein the operator-settable machine control means can also be used to vary the machine settings as determined by the computer control means in accordance with the output value information received from the first and second transducer means, the computer control means storing the variation information and thereafter applying it in determining the machine settings as aforesaid.

26. Apparatus according to claim 25 wherein the machine setting information which, when a manual operating mode has been selected, is set using the operator-settable machine control means is stored by the computer control means not only while such manual operating mode remains selected, but also in the event that an automatic operating mode is selected and is recallable when a manual operating mode is thereafter selected.

27. Apparatus according to claim 1 wherein operator-settable machine control means is provided whereby the machine settings as determined by the computer control means in accordance with the output value information received from the first and second transducer means of the pulling over and toe lasting machine can be varied, the computer control means storing the variation information and thereafter applying it in determining the settings of the side and heel seat lasting machine as aforesaid.

28. Apparatus according to claim 1 wherein the second motor means comprises two n.c. motors (as hereinbefore defined), one associated with each of the side lasting assemblies, and wherein for calibrating each motor each assembly can be moved by its motor to a datum position.

29. Apparatus according to claim 28 wherein indicator means is provided, operable in response to either of the side lasting assemblies being prevented from being set in accordance with the output value information, for indicating that calibration of the motors is required.

30. Apparatus according to claim 28 wherein further transducer means is associated with the first motor means for controlling the distance through which the nozzles are moved in accordance with the output value information received from the first and second transducer means.

31. Apparatus according to claim 30 wherein the computer control means is also effective, in accordance with the output value information received from the first and second transducer means, to switch off the flow of adhesive to the nozzles.

32. Apparatus according to claim 30 wherein each side lasting assembly of the side and heel seat lasting machine comprises a plurality of lasting members arranged side-by-side along the length of the side portion of a shoe to be operated upon, and wherein, in accordance with the output value information received from the first and second transducer means of the pulling over and toe lasting machine, only as many such members are actuated as correspond to the distance through which the nozzles are caused to track as aforesaid.

33. Apparatus according to claim 32 wherein the computer control means is also effective, in accordance with the output value information received from the first and second transducer means, to switch off the flow of adhesive to the nozzles.

34. Apparatus according to claim 30 wherein the further transducer means is further used for controlling the flow of adhesive from the nozzles and also heightwise movement of the nozzles relative to the shoe bottom and the incidence of such movement.

35. Apparatus according to claim 1 wherein further transducer means is associated with the first motor means for controlling the distance through which the nozzles are moved in accordance with the output value information received from the first and second transducer means.

36. Apparatus according to claim 35 wherein the further transducer means is further used for controlling the flow of adhesive from the nozzles and also heightwise movement of the nozzles relative to the shoe bottom and the incidence of such movement.

37. Apparatus according to claim 36 wherein for controlling each function as aforesaid, the output value of the further transducer means is compared with other values set appropriately by the computer control means in accordance with the output value information received from the first and second transducer means, each function being caused to take place when the output value of the further transducer means matches each corresponding set value.

38. Apparatus according to claim 1 also comprising an automatic unloading device whereby a finished shoe can be removed from the shoe support of the side and heel seat lasting machine, inhibiting means being provided for delaying the setting as aforesaid of the side and heel seat lasting machine for the next operating cycle thereof to allow for the removal of the finished shoe.

39. Apparatus according to claim 38 wherein switch means is provided for selecting a manually initiated mode of operation of the unloading device, selection of such mode being effective to disable the inhibiting means.

40. Apparatus according to claim 38 wherein the computer control means comprises a memory in the form of a table having a plurality of addresses in which output value information received in response to operation of the actuator means in respect of successive shoes is stored in sequence, together with means for accessing each such address in sequence and setting up the side and heel seat lasting machine accordingly.

* * * * *